US010943428B2

(12) United States Patent
Ambrecht et al.

(10) Patent No.: US 10,943,428 B2
(45) Date of Patent: Mar. 9, 2021

(54) ACCESS PANEL SAFETY MECHANISM IMPLEMENTED IN A GAMING DEVICE

(71) Applicant: AGS LLC, Las Vegas, NV (US)

(72) Inventors: Adam Daniel Ambrecht, Kennesaw, GA (US); Kevin Lee Hohman, North Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 8 days.

(21) Appl. No.: 16/413,288

(22) Filed: May 15, 2019

(65) Prior Publication Data

US 2019/0266835 A1 Aug. 29, 2019

Related U.S. Application Data

(63) Continuation-in-part of application No. 29/635,853, filed on Feb. 2, 2018, now abandoned, and a continuation-in-part of application No. 29/614,799, filed on Aug. 23, 2017, now Pat. No. Des. 865,873.

(51) Int. Cl.
*G07F 17/32* (2006.01)

(52) U.S. Cl.
CPC ..... *G07F 17/3216* (2013.01)

(58) Field of Classification Search
CPC ..... G07F 17/3216
See application file for complete search history.

(56) References Cited

U.S. PATENT DOCUMENTS 1,692,064 A * 11/1928 Trogner ..... H04B 1/08 174/520
2,023,356 A * 12/1935 Fain ..... A47B 83/045 312/201
6,699,128 B1 * 3/2004 Beadell ..... G07F 17/32 292/106
6,962,528 B2 * 11/2005 Yokota ..... G07F 17/32 463/25
7,862,436 B2 * 1/2011 Cole ..... G07F 17/32 463/47
8,109,583 B2 * 2/2012 Bruestle ..... A47B 88/457 312/319.2
8,210,949 B2 7/2012 Graf
8,366,555 B2 * 2/2013 McGahn ..... G07F 17/3216 463/46
9,010,889 B2 * 4/2015 Jung ..... F25D 25/025 312/404
9,033,436 B2 * 5/2015 Holzapfel ..... A47B 88/956 312/348.4
9,679,435 B2 6/2017 Schrementi et al.
2005/0049043 A1 * 3/2005 Crivelli ..... G07F 17/32 463/29
2006/0073900 A1 * 4/2006 Cole ..... G07F 17/323 463/46
2008/0113740 A1 * 5/2008 McGahn ..... E05B 65/006 463/20

(Continued)

*Primary Examiner* — Hanh V Tran
(74) *Attorney, Agent, or Firm* — Wolf IP Law PLLC; Dean E. Wolf, Esq.

(57) ABSTRACT

Various aspects described or referenced herein are directed to improved access panel assembly safety mechanisms which may be incorporated into various gaming machine designs in order to help mitigate or facilitate reductions in safety hazards associated with such gaming machines and/or components thereof.

18 Claims, 19 Drawing Sheets

(56) References Cited

U.S. PATENT DOCUMENTS

| | | | | |
|---|---|---|---|---|
| 2008/0113818 | A1* | 5/2008 | Beadell | A63F 13/90 463/46 |
| 2008/0119289 | A1* | 5/2008 | Lind | G07F 17/3216 463/46 |
| 2008/0227554 | A1* | 9/2008 | Cole | G07F 17/3216 463/46 |
| 2011/0092283 | A1* | 4/2011 | Levitan | A63F 13/08 463/31 |
| 2013/0023346 | A1* | 1/2013 | Greenberg | G07F 17/3216 463/46 |
| 2015/0087401 | A1* | 3/2015 | Glenn, II | G07F 17/3211 463/25 |
| 2016/0005267 | A1* | 1/2016 | Kawashima | G07F 17/3216 463/46 |
| 2016/0343204 | A1* | 11/2016 | Maher | E05F 3/02 |
| 2017/0053482 | A1* | 2/2017 | Ho | G07F 17/3216 |
| 2017/0061730 | A1* | 3/2017 | Ho | G07F 17/3211 |
| 2019/0080553 | A1* | 3/2019 | Hohman | G07F 17/3216 |
| 2019/0096171 | A1* | 3/2019 | Patel | E05D 5/06 |
| 2019/0096173 | A1* | 3/2019 | Brandau | G07F 17/3216 |

* cited by examiner

500

ACCESS PANEL SAFETY MECHANISM IMPLEMENTED IN A GAMING DEVICE

RELATED APPLICATION DATA

This application is a continuation-in-part application, pursuant to the provisions of 35 U.S.C. § 120, of prior U.S. Design patent application Ser. No. 29/614,799 titled "GAMING MACHINE" by LEWIS et al., filed on 23 Aug. 2017, the entirety of which is incorporated herein by reference for all purposes.

This application is a continuation-in-part application, pursuant to the provisions of 35 U.S.C. § 120, of prior U.S. Design patent application Ser. No. 29/635,853 titled "SUPPORT STRUCTURE FOR GAMING MACHINE DISPLAY" by LEE et al., filed on 2 Feb. 2018, the entirety of which is incorporated herein by reference for all purposes.

TECHNICAL FIELD

The present disclosure relates generally to gaming devices, such as electronic wager-based gaming devices. More particularly, the present disclosure relates to an improved access panel assembly safety mechanism implemented in a gaming device which is configured or designed to help reduce or prevent injury during use.

BACKGROUND

Mechanical and electronic gaming machines are generally well known and have been relatively popular, and profitable, for a number of years. Such machines can be configured to provide a variety of casino or entertainment games, including for example, mechanical or electromechanical slot-type matching games, video games or electronic casino games, such as video poker, blackjack, keno, roulette, etc. Such gaming machines typically have an exterior cabinet or housing enclosing the game's mechanical or electronic components, a user input device or control panel, and one or more displays or arrays for visually presenting the game to a player.

Typically, such gaming machines are arranged at gaming establishments in clusters or banks consisting of at least two machines that are physically located adjacent or in close proximity to one another. Usually, gaming machines in a bank will be the same, size style or type (e.g., upright, slant-top, table-top), be made by the same manufacturer, and/or offer identical or related games having a common themes, characters or methods of play.

U.S. Design patent application Ser. No. 29/614,799 and U.S. Design patent application Ser. No. 29/635,853 each disclose several different embodiments of gaming machine designs which include multiple electronic display devices. An example one such gaming cabinet design is illustrated in FIGS. 1 and 2. More specifically, FIG. 1 illustrates a front perspective view of an example embodiment of an electronic gaming device ("EGM") 100 which includes multiple electronic display devices (e.g., 126, 124, 122). FIG. 2 shows a side view of the electronic EGM according to one embodiment. As illustrated in the example embodiment of FIG. 2, the EGM includes a display support frame 130 which is configured or designed to support attachment of electronic display devices 122 and 124.

In at least some embodiments, industrial design considerations for these types of multi-display gaming cabinet designs may require the inclusion of an access panel assembly between two adjacent monitors (e.g., 122, 124). For example, as illustrated in the example embodiment of FIG. 29, the access panel assembly may comprise a security plate (e.g., 2910, FIG. 29) which is configured or designed such that it is able to be removed for servicing of the monitors, and is able to be securely closed to provide cabinet/game security. Additionally, due to security and design considerations, it is preferable that this access panel assembly not include any exposed fasteners which, for example, might be visible or accessible to patrons engaging in game play at the EGM.

The inclusion of an access panel assembly between the adjacent display devices 122 and 124 may give rise to one or more safety concerns. For example, each of the display devices 122 and 124 may be large and heavy, making them difficult to be moved and positioned properly, when mounting and/or unmounting the display device(s) to/from the display support frame. Because each display device is relatively heavy, the accidental slipping or falling of a display device may cause serious bodily injury, for example, if fingers or hands impede its motion, particularly in situations such as that illustrated in FIG. 29, where fingers or hands (e.g., 2920) get pinched between the edge of the display device 122 an exposed edge of the access panel security plate 2910. Other safety considerations may relate to the display device weight and geometry, the geometry of the surfaces and edges of display support frame, the locations of the interfacing surfaces, etc. Additionally, in some situations, the edges that might cause injury may not be immediately visible while servicing the display device(s).

Accordingly, at least one objective of the present disclosure is to provide an improved gaming cabinet access panel assembly design which reduces or mitigates potential safety hazard issues.

BRIEF DESCRIPTION OF THE DRAWINGS

The included drawings are for illustrative purposes and serve only to provide examples of possible structures and arrangements for the disclosed inventive apparatuses, systems and methods described herein. These drawings in no way limit any changes in form and detail that may be made to the disclosure by one skilled in the art without departing from the spirit and scope of the disclosure.

DETAILED DESCRIPTION OF EXAMPLE EMBODIMENTS

Overview

Figure 2:
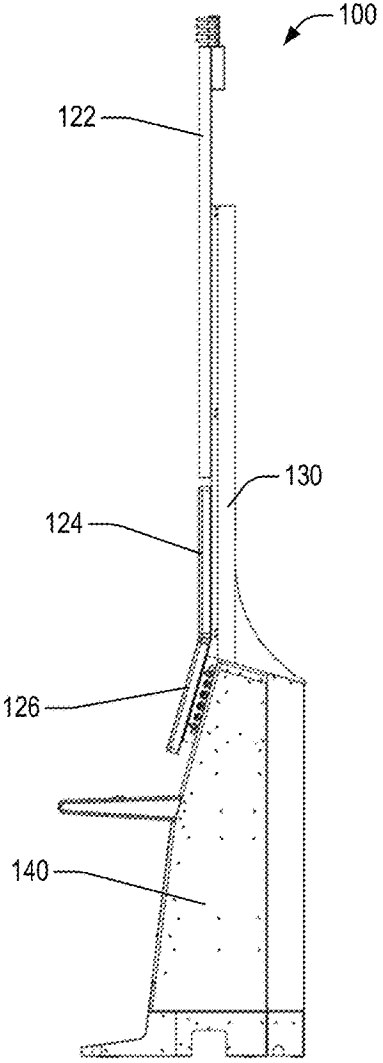
FIG. 2 shows a side view of the electronic EGM 100 according to one embodiment.

Various aspects described or referenced herein are directed to an improved gaming device with an Access panel assembly latching mechanism which is configured or designed to help reduce or prevent injury during use. In at least one embodiment, the latching mechanism is designed in such a way that an action which might otherwise cause an injury from human contact with the access door instead acts to cause the access door to automatically move to an "open" position such that the potential injury may be avoided. In at least one embodiment, the latching mechanism is arranged along the most distal edge of the access panel assembly, where first contact is most likely to occur.

Various aspects described or referenced herein are directed to different methods and/or systems for a gaming machine comprising: a cabinet including an entry that provides access to an interior of the cabinet; a display support frame disposed at an exterior portion of the cabinet, the display support frame including a first mounting interface disposed at a first region of the display support frame and designed to enable a first display device to be mounted to the display support frame at the first region, the display support frame including a second mounting interface disposed at a second region of the display support frame and adapted to enable a second display device to be mounted to the display support frame at the second region; an access panel assembly movably attached to the display support frame at a location between the first region and second region, the access panel assembly being movably attached to the display support frame via a first set of connectors and in a manner which enables the access panel assembly to move between a closed position and an open position; the access panel assembly including a security plate component and a movable safety bar component, the safety bar component being movably attached to the security plate component via a second set of connectors and in a manner which enables the safety bar component to be movable between an extended position and a retracted position; and the access panel assembly being designed to automatically move to the open position when the safety bar component is moved to the retracted position.

Additional aspects described or referenced herein are directed to different methods and/or systems for an access panel assembly for use in a gaming machine, the gaming machine comprising a cabinet including an entry that provides access to an interior of the cabinet, the gaming machine further including a display support frame disposed at an exterior portion of the cabinet, the display support frame including a first mounting interface disposed at a first region of the display support frame and designed to enable a first display device to be mounted to the display support frame at the first region, the display support frame including a second mounting interface disposed at a second region of the display support frame and adapted to enable a second display device to be mounted to the display support frame at the second region, the access panel assembly comprising: a security plate component, the security plate component comprising a security plate body and security plate arms attached to the security plate body, the security plate arms including a first set of attachment components for movably attaching the security plate component to the display support frame in a manner which enables the access panel assembly to move between a closed position and an open position; a movable safety bar component, the safety bar component being movably attached to the security plate component via a second set of attachment components and in a manner which enables the safety bar component to be movable between an extended position and a retracted position; a self-latching mechanism designed to cause the access panel assembly to latch itself in the closed position to the display support frame; and the access panel assembly being designed such that, when the access panel assembly is configured in the closed position and the safety bar component is moved into the retracted position, the access panel assembly is caused to automatically unlatch from the display support frame and caused to move to the open position.

In at least some embodiments, the security plate component includes a security plate body portion, the security plate body portion having a first end portion and a second end portion; the security plate component further including a first security plate arm member connected to the first end portion, the first security plate arm member including a first connector of the second set of connectors; the security plate component further including a second security plate arm member connected to the second end portion, the second security plate arm member including a second connector of the second set of connectors; the safety bar component includes a safety bar body portion, the safety bar body portion having a first safety bar end portion and a second safety bar end portion; the safety bar component further including a first safety bar arm member connected to the first safety bar end portion, the first safety bar arm portion including a third connector of the second set of connectors; the safety bar component further including a second safety bar arm member connected to the second safety bar end portion, the second safety bar arm portion including a fourth connector of the second set of connectors; and the first safety bar arm member is movably attached to the first security plate arm member via engagement of the first and third connectors; and the second safety bar arm member is movably attached to the second security plate arm member via engagement of the second and fourth connectors.

In some embodiments, the access panel assembly is designed such that, when the access panel assembly is configured in the closed position and the safety bar component is moved into the retracted position, the access panel assembly is caused to automatically unlatch from the display support frame and caused to move to the open position.

In some embodiments, the access panel assembly further includes a self-latching mechanism designed to cause the access panel assembly to automatically latch itself in the closed position to the display support frame.

In some embodiments, the safety bar component is designed to operate as a self-latching mechanism to cause the access panel assembly to automatically latch itself in the closed position to the display support frame.

In some embodiments, the access panel assembly includes a spring mechanism which is designed engage with the safety bar component in a manner which causes the safety bar component to automatically move from the retracted position to the extended position.

In some embodiments, the safety bar component is designed to operate as a safety mechanism for causing the access panel assembly to automatically move to the open position when the safety bar component is moved.

In some embodiments, the access panel assembly is devoid of exposed fasteners while the access panel assembly is configured in the closed position.

In some embodiments, the gaming machine includes a first display device mounted to the display support frame above the access panel assembly; and the access panel assembly is designed and movably attached to the display support frame in a manner which enables the access panel assembly to be moved from the open position to the closed position while the first display device is mounted to the display support frame. In some embodiments, when the access panel assembly is moved from the open position to the closed position, the safety bar component is caused to engage with a lower edge portion of the first display device; and while the safety bar component engages with the lower edge portion of the first display device, the safety bar component is caused to move into at least a partially retracted position.

Various objects, features and advantages of the various aspects described or referenced herein will become apparent from the following descriptions of its example embodiments, which descriptions should be taken in conjunction with the accompanying drawings.

SPECIFIC EXAMPLE EMBODIMENTS

Various techniques will now be described in detail with reference to a few example embodiments thereof as illustrated in the accompanying drawings. In the following description, numerous specific details are set forth in order to provide a thorough understanding of one or more aspects and/or features described or reference herein. It will be apparent, however, to one skilled in the art, that one or more aspects and/or features described or reference herein may be practiced without some or all of these specific details. In other instances, well known process steps and/or structures have not been described in detail in order to not obscure some of the aspects and/or features described or reference herein.

One or more different inventions may be described in the present application. Further, for one or more of the invention(s) described herein, numerous embodiments may be described in this patent application, and are presented for illustrative purposes only. The described embodiments are not intended to be limiting in any sense. One or more of the invention(s) may be widely applicable to numerous embodiments, as is readily apparent from the disclosure. These embodiments are described in sufficient detail to enable those skilled in the art to practice one or more of the invention(s), and it is to be understood that other embodiments may be utilized and that structural, logical, software, electrical and other changes may be made without departing from the scope of the one or more of the invention(s). Accordingly, those skilled in the art will recognize that the one or more of the invention(s) may be practiced with various modifications and alterations. Particular features of one or more of the invention(s) may be described with reference to one or more particular embodiments or figures that form a part of the present disclosure, and in which are shown, by way of illustration, specific embodiments of one or more of the invention(s). It should be understood, however, that such features are not limited to usage in the one or more particular embodiments or figures with reference to which they are described. The present disclosure is neither a literal description of all embodiments of one or more of the invention(s) nor a listing of features of one or more of the invention(s) that must be present in all embodiments.

Headings of sections provided in this patent application and the title of this patent application are for convenience only, and are not to be taken as limiting the disclosure in any way. Devices that are in communication with each other need not be in continuous communication with each other, unless expressly specified otherwise. In addition, devices that are in communication with each other may communicate directly or indirectly through one or more intermediaries. A description of an embodiment with several components in communication with each other does not imply that all such components are required. To the contrary, a variety of optional components are described to illustrate the wide variety of possible embodiments of one or more of the invention(s).

Further, although process steps, method steps, algorithms or the like may be described in a sequential order, such processes, methods and algorithms may be configured to work in alternate orders. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred.

When a single device or article is described, it will be readily apparent that more than one device/article (e.g., whether or not they cooperate) may be used in place of a single device/article. Similarly, where more than one device or article is described (e.g., whether or not they cooperate), it will be readily apparent that a single device/article may be used in place of the more than one device or article. The functionality and/or the features of a device may be alternatively embodied by one or more other devices that are not explicitly described as having such functionality/features. Thus, other embodiments of one or more of the invention(s) need not include the device itself. Techniques and mechanisms described or reference herein will sometimes be described in singular form for clarity. However, it should be noted that particular embodiments include multiple iterations of a technique or multiple instantiations of a mechanism unless noted otherwise.

Although these embodiments are described in sufficient detail to enable one skilled in the art to practice the disclosure, it is understood that these examples are not limiting, such that other embodiments may be used, and changes may be made without departing from the spirit and scope of the disclosure.

Figure 1:
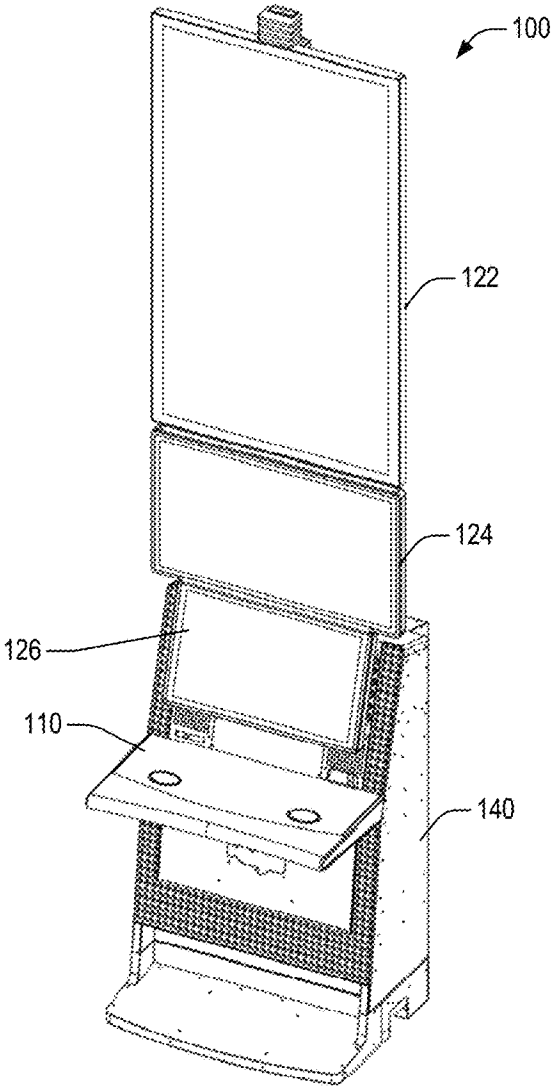
FIG. 1 illustrates a front perspective view of an example embodiment of an electronic gaming device ("EGM") 100 which includes multiple electronic display devices (e.g., 126, 124, 122).

FIG. 1 illustrates a front perspective view of an example embodiment of an electronic gaming device ("EGD") or electronic gaming machine ("EGM") 100 which includes multiple electronic display devices (e.g., 126, 124, 122). FIG. 2 shows a side view of the electronic EGM 100 of FIG. 1, according to one embodiment.

In various embodiments, methods of game play and presentation can be implemented via an EGM or device 100. Such an EGM 100 may have various configurations, and again may facilitate the play of wager-based games and/or other games that are not wager-based. The EGM 100 may be located at a casino or other gaming establishment. The EGM 100 may be part of a gaming system, such as a casino gaming system which links multiples of the EGMs, one or more table games, and/or other devices such as kiosks, accounting systems, progressive systems, player tracking systems, respective servers thereof, and the like.

As illustrated in the example embodiment of FIG. 1, EGM 100 generally comprises a physical housing or cabinet 140 for supporting and/or enclosing various components required for operation of the EGM. Housing 140 can include a main access door, the door capable of being moved between an open position that allows access to the interior of the gaming cabinet, and a closed position where access to the interior is generally prevented. Configurations of the EGM 100 may vary. Although EGM 100 has an "upright" configuration as shown, alternative configurations, shapes, or dimensions can include a "slant" type, "bar-top" type, "cocktail table" type, and/or other configurations, as are well known to those of skilled in the art.

In various embodiments, EGM 100 can be configured to present one or more wager-based games upon a player making a monetary payment or wager. In this regard, EGM 100 can include means for accepting monetary value or coin in. In various embodiments, certain game outcomes may be designated as winning outcomes. Prizes or awards may be provided for winning outcomes, such as monetary payments (or representations thereof, such as prize of credits), or promotional awards. The EGM 100 can also include mean for returning unused monetary funds and/or dispensing winnings to a player, such as by way of physical coins, printed tickets, cash vouchers, electronically stored credits to player accounts, and the like. In some embodiments, the EGM 100 may include a coin acceptor and a coin tray.

In the specific example embodiment of FIG. 1, EGM 100 includes a main cabinet 140, which generally surrounds the machine interior and is viewable by users. Mounted to the cabinet is a button panel assembly 110 which extends outward from the front of the cabinet.

Figure 4:
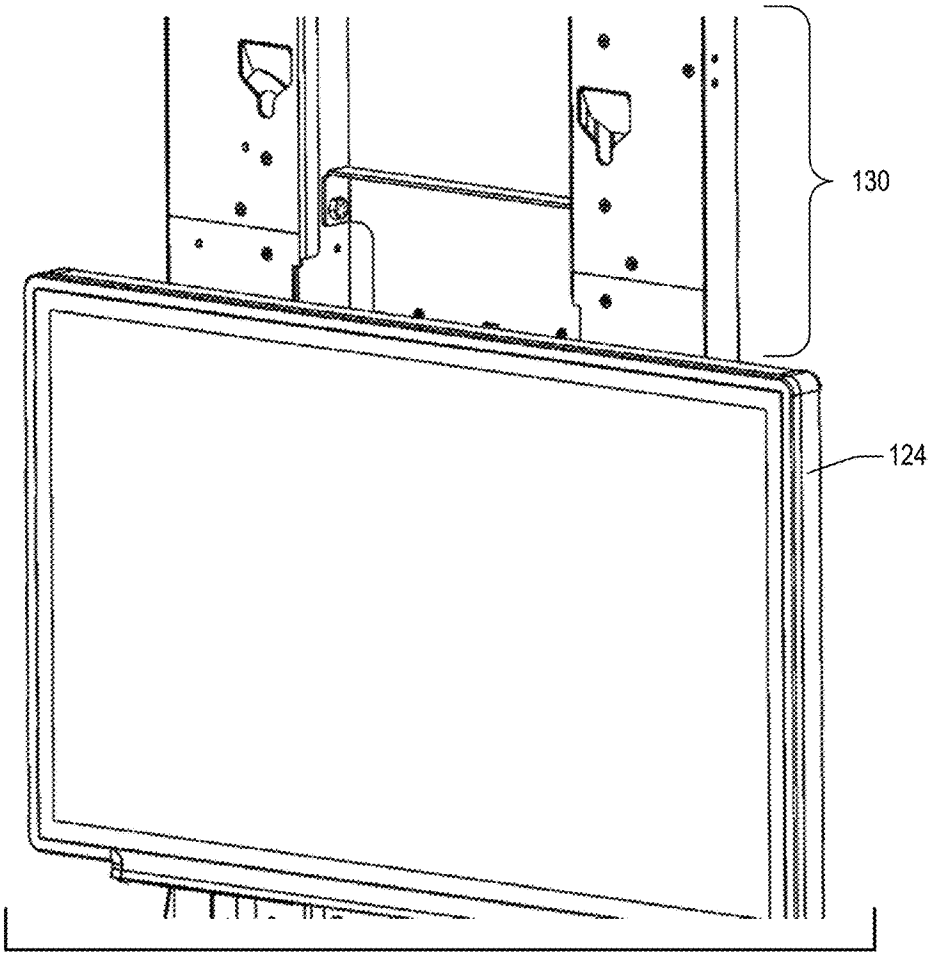
FIGS. 3-4 illustrate example embodiments showing how electronic display device 122 (FIG. 3) and/or electronic display device 123 (FIG. 4) may be mounted to the display support frame 130 of the EGM 100.
Figure 3:
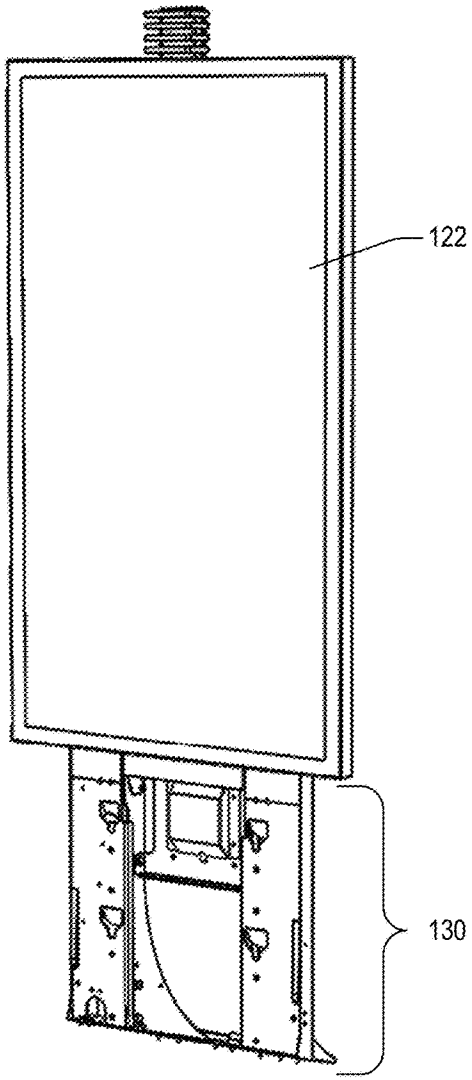

As illustrated in the example embodiment of FIG. 2, the EGM 100 also includes a display support frame 130 which is configured or designed to support mounting of electronic display devices (e.g., 122, 124) thereto. FIGS. 3-4 illustrate example embodiments showing how electronic display device 122 (FIG. 3) and/or electronic display device 123 (FIG. 4) may be mounted to the display support frame 130 of the EGM 100.

According to different embodiments, the display devices may correspond to a plurality of different video displays such as a high-resolution, flat-panel liquid crystal displays (LCD), which, for example, may be configured or designed to display game play content and/or information relating to various aspects of wager-based game play and/or other content.

In at least some embodiments, industrial design considerations make it preferable for multi-display gaming cabinet designs (e.g., such as that illustrated in FIGS. 1-2) to include an access panel assembly between two adjacent display devices (e.g., 122, 124). Additionally, in at least some embodiments, aesthetic considerations make it preferable for the spacing between two adjacent display devices to be as minimal as possible, while still being able to incorporate an access panel in the spacing between the two adjacent monitors. In at least one embodiment, the access panel assembly may comprise a security plate which is configured or designed such that it is able to be moved or removed for access to, and servicing of, the display devices (e.g., 122, 124) which are mounted to the display support frame 130. Additionally the security plate may be further configured or designed such that it is able to be configured in a "closed" configuration to provide cabinet/game security. Additionally, due to security, regulatory, and/or other design considerations, in at least some embodiments, it may be preferable or required that the access panel assembly not include any exposed fasteners which, for example, might be visible or accessible to patrons engaging in game play at the EGM.

As noted above, the inclusion of an access panel assembly between the adjacent display devices 122 and 124 may give rise to one or more safety concerns. For example, in some embodiments, if the access panel assembly is configured in a closed position during the installation process of one or more of the display devices (e.g., 122, 124), the access panel assembly may pose a safety hazard for the installer's fingers/hand. Accordingly, at least one objective of the present disclosure is to provide an improved gaming cabinet access panel assembly design which reduces or mitigates potential safety hazard issues.

An example embodiment of one such improved gaming cabinet access panel assembly design is illustrated, for example, in FIGS. 8-11 of the drawings.

Figure 5:
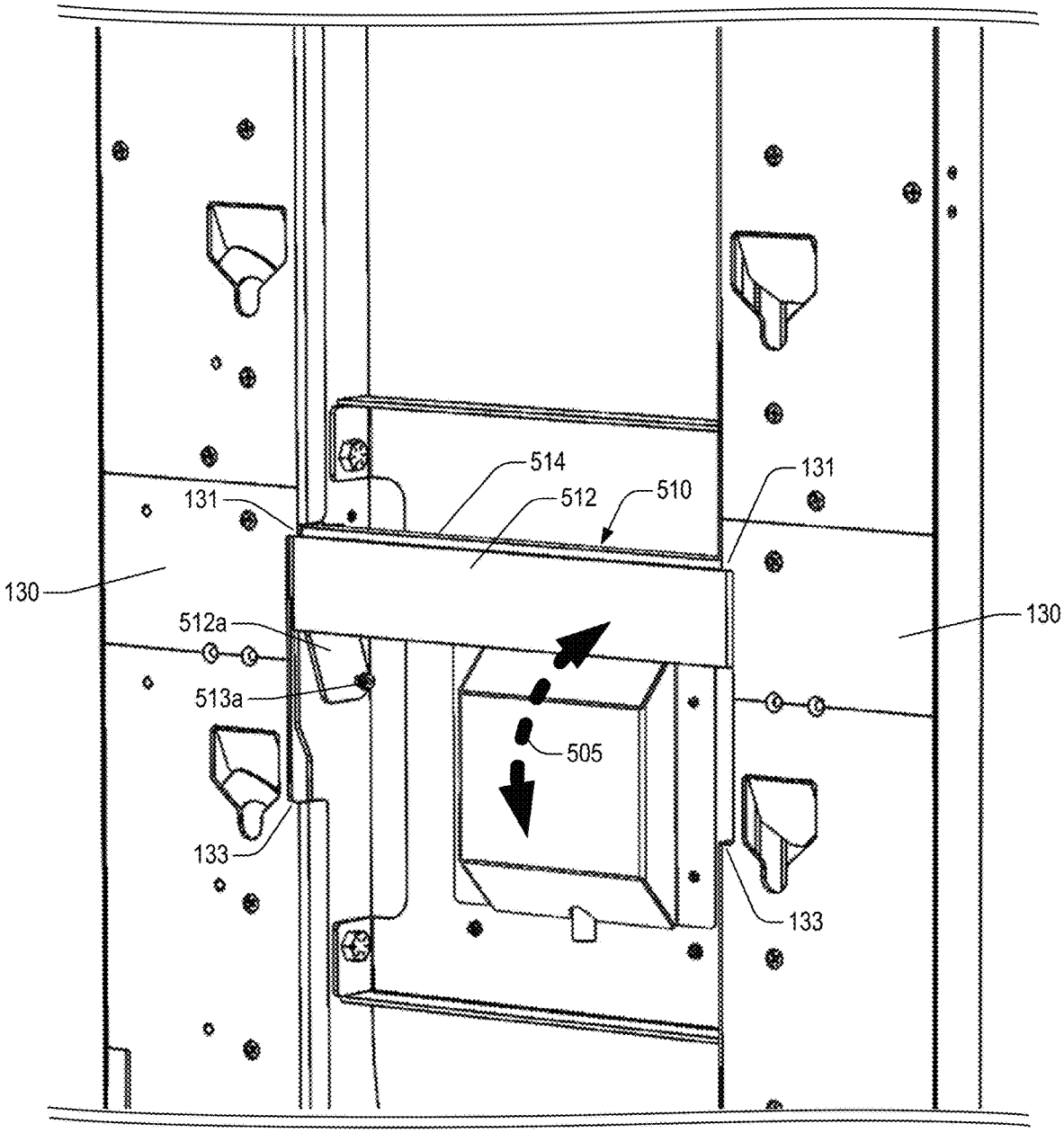
FIG. 5 illustrates a front perspective view of an access panel assembly that is movably or pivotably attached to the display support frame 130 via fasteners 513*a* which engage with mounting holes 513.
Figure 8:
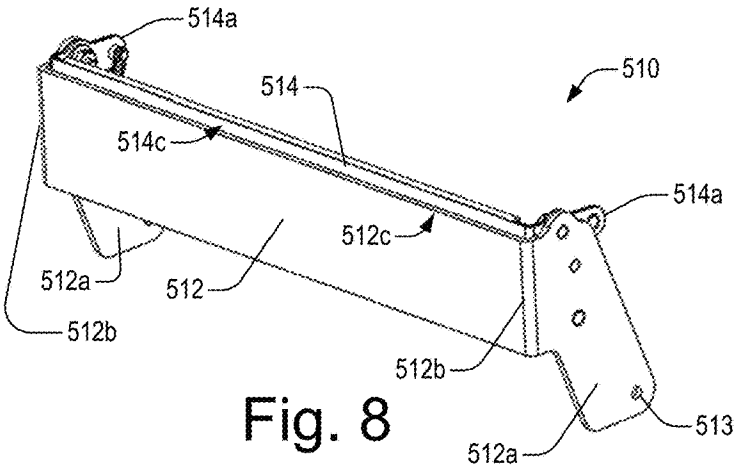
FIG. 8 illustrates a front perspective view of an access panel assembly 510 which is configured or designed to include a safety mechanism for reducing or mitigating potential safety hazard issues.
Figure 12:
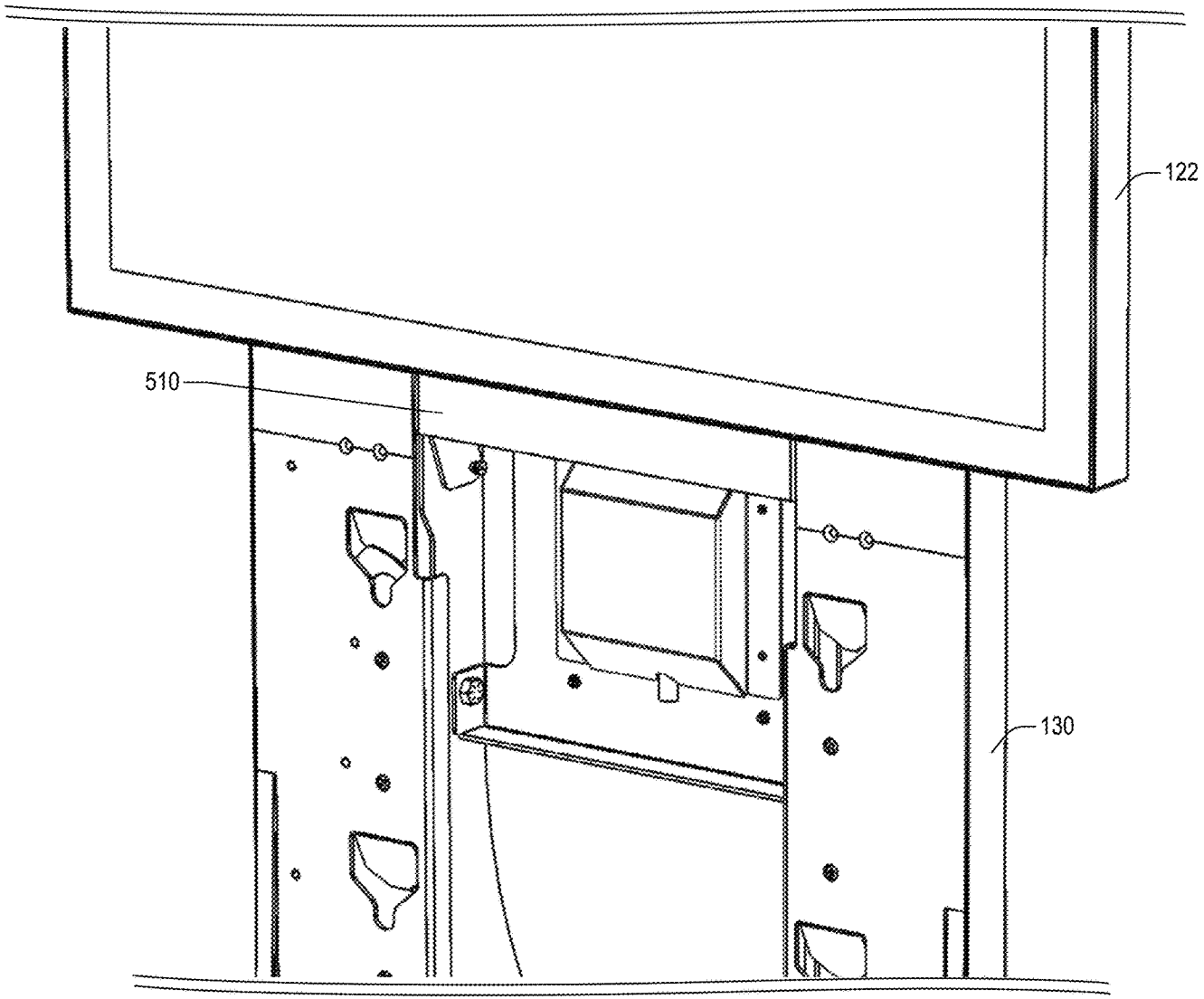
FIG. 12 illustrates a front perspective view of a portion 1200 of a gaming machine cabinet which includes an access panel assembly 510, a display support frame 130, and a display device 122 which has been mounted to the display support frame 130 above the access panel assembly 510.
Figure 15:
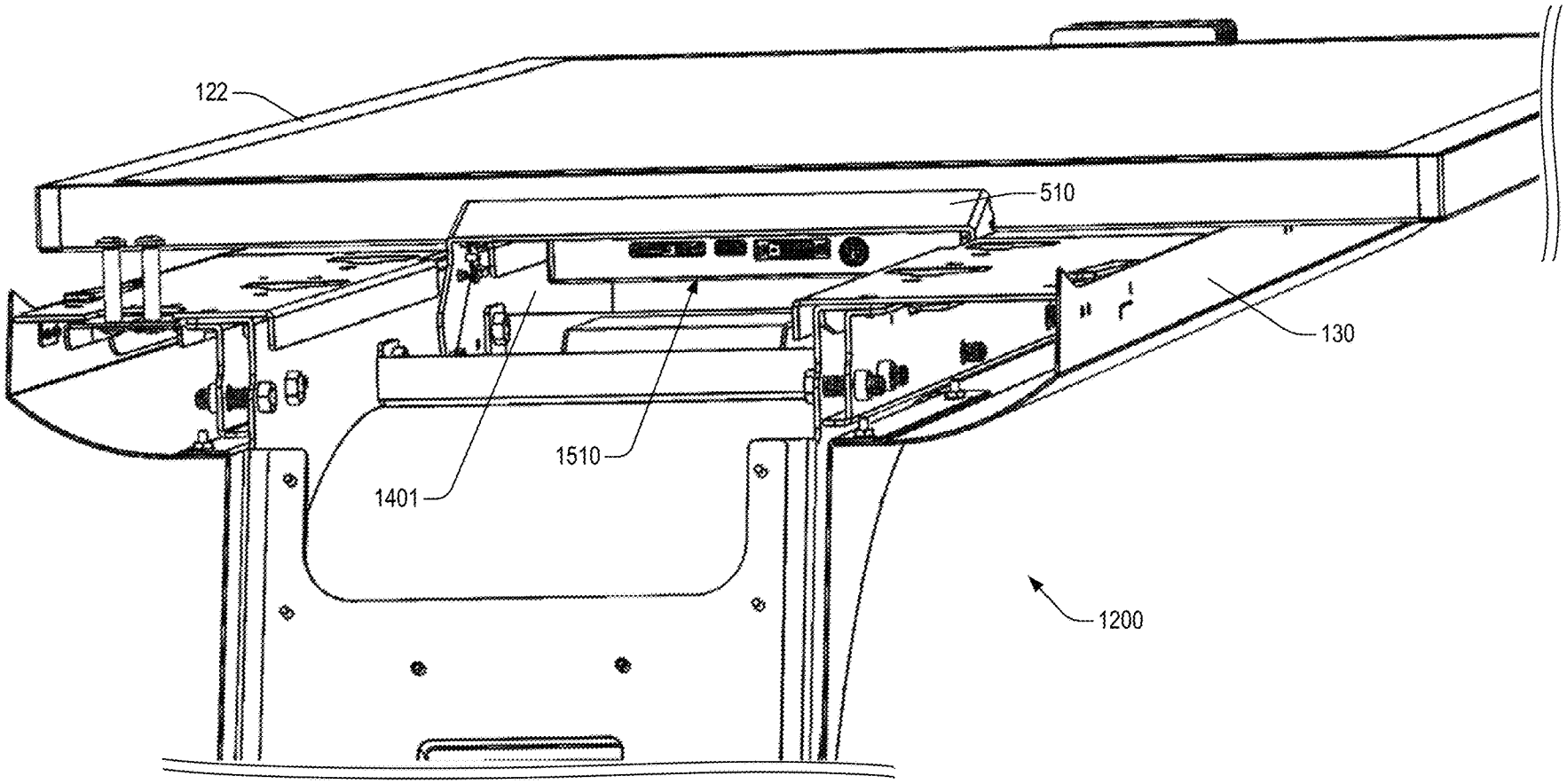
FIG. 15 illustrates a bottom perspective view of gaming machine cabinet portion 1200 showing the access panel assembly 510 positioned in its "fully open" configuration.
Figure 20:
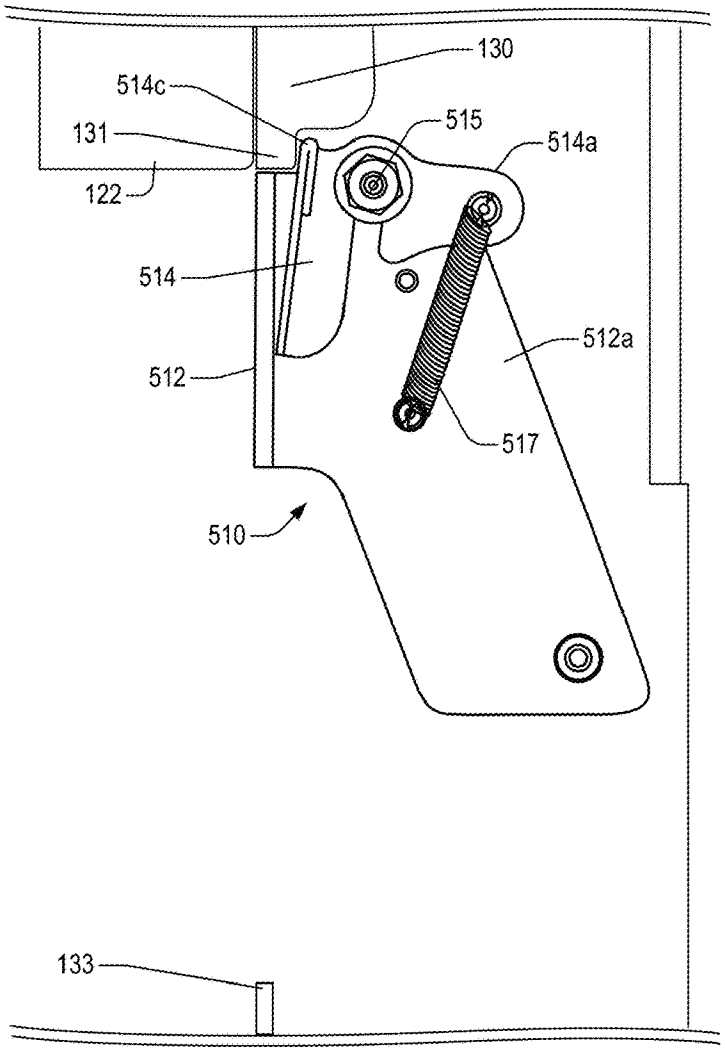

FIG. 8 illustrates a front perspective view of an access panel assembly 510 which is configured or designed to include a safety mechanism for reducing or mitigating potential safety hazard issues. More specifically, as illustrated in the example embodiment of FIG. 8, the access panel assembly includes a security plate component 512 which is configured or designed such that:

(a) it is able to configured to a "closed" configuration to provide desired cabinet/game security (e.g., as illustrated in FIGS. 5, 12, 20); and (b) it is able to be configured to at least one "open" configuration (e.g., as illustrated in FIGS. 6, 7, 13-15, 16) for:

(i) facilitating mounting of one or more display devices (e.g., 122, 124) to the display support frame 130, (ii) facilitating removal or unmounting of one or more display devices from the display support frame 130, (iii) facilitating access to the input/output port(s) of one or more display devices (e.g., as illustrated in FIG. 15), and (iv) facilitating servicing of one or more of the display devices mounted to the display support frame 130.

Additionally, as illustrated in the example embodiment of FIG. 8, the access panel assembly 510 also includes a movable safety bar component (e.g., 514) which is movably attached to the security plate component.

Figure 9:
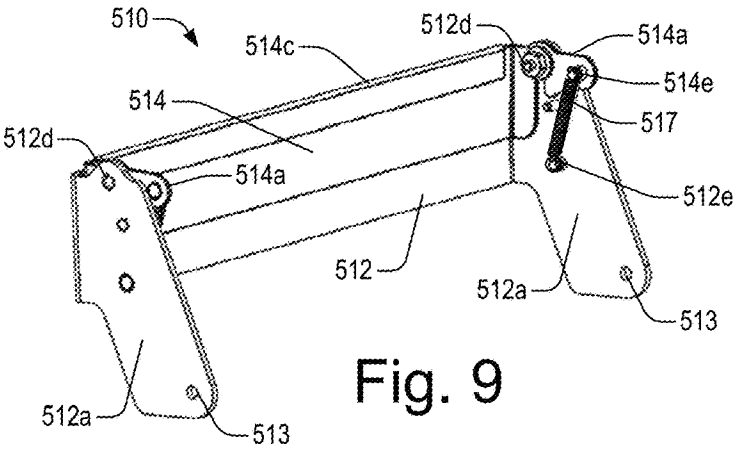
FIG. 9 illustrates a rear perspective view of the access panel assembly 510 of FIG. 8.

FIG. 9 illustrates a rear perspective view of the access panel assembly 510 of FIG. 8.

Figure 24:
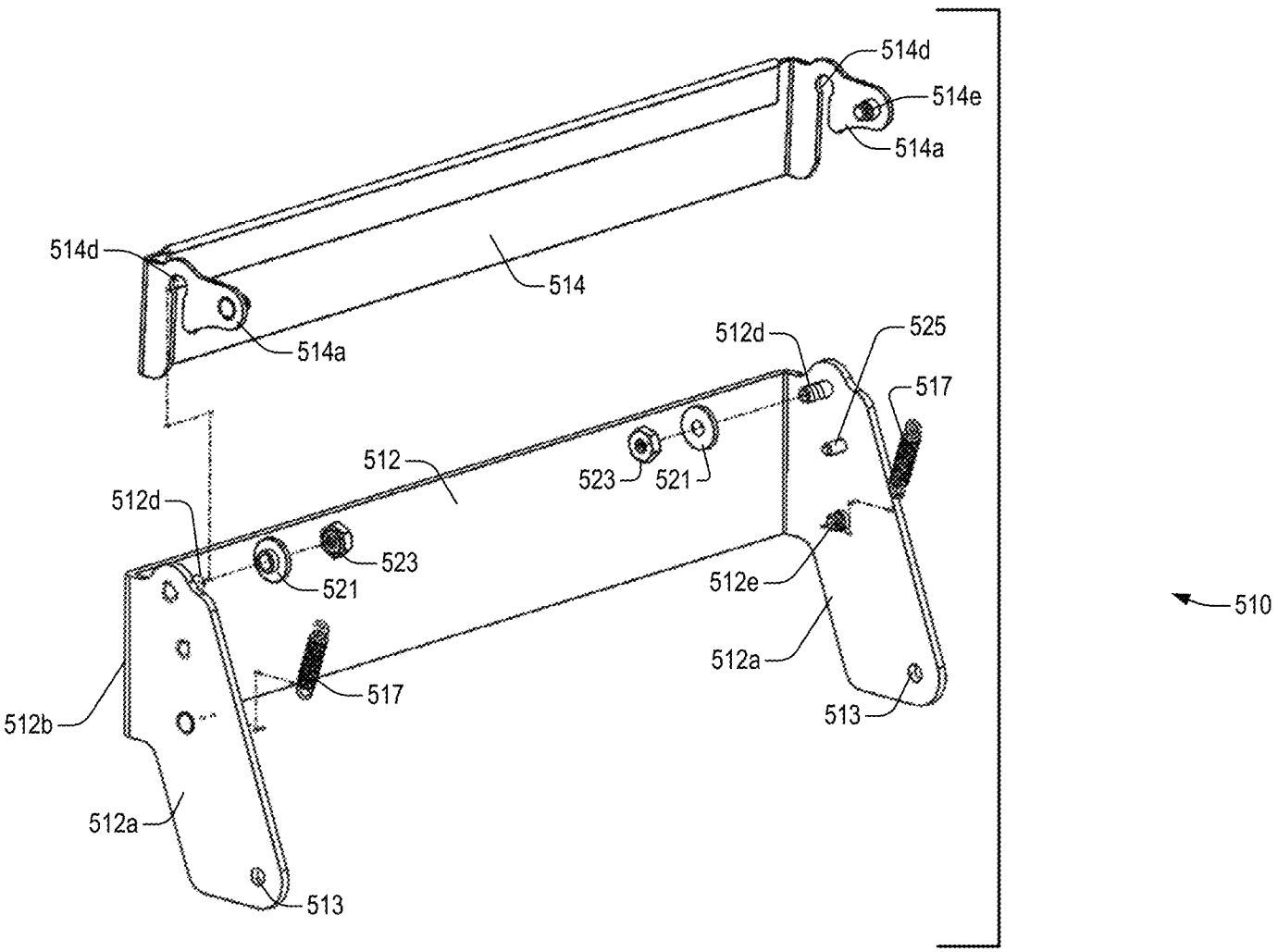
FIG. 24 illustrates a rear perspective exploded view of an example embodiment of an access panel assembly 510.

FIG. 24 illustrates a rear perspective exploded view of an example embodiment of an access panel assembly 510. According to different embodiments, the safety bar component 514 of the access panel assembly 510 may be movably attached to the security plate component 512 by means of various types of connectors such as, for example, slots (e.g., 514*d*, FIG. 24), pins (e.g., 512*d*, FIG. 24), screws, nuts (e.g., 523, FIG. 24), bolts, washers (e.g., 521, FIG. 24), and/or other types of coupling components. For example, in the example embodiment of FIG. 24, safety bar component 514 may be movably attached or coupled to the security plate component 512 by engaging slot portions 514*d* with threaded pin members 512*d*, and securing the components together using washers 521 and nuts 523. In other embodiments (not shown), other types of coupling mechanisms may be used to movably attach or couple to the safety bar component 514 to the security plate component 512.

In at least one embodiment, as illustrated in the example embodiment of FIGS. 8-9, the safety bar component 514 may be movably attached to the security plate component 512 in a manner such that the safety bar component 514 is movable to an "extended" position, whereby an upper edge (or lip) portion (e.g., 514*c*) of the safety bar component 514 is positioned to extend "upward" beyond the upper edge portion (e.g., 512*c*) of the security plate component.

Figure 11:
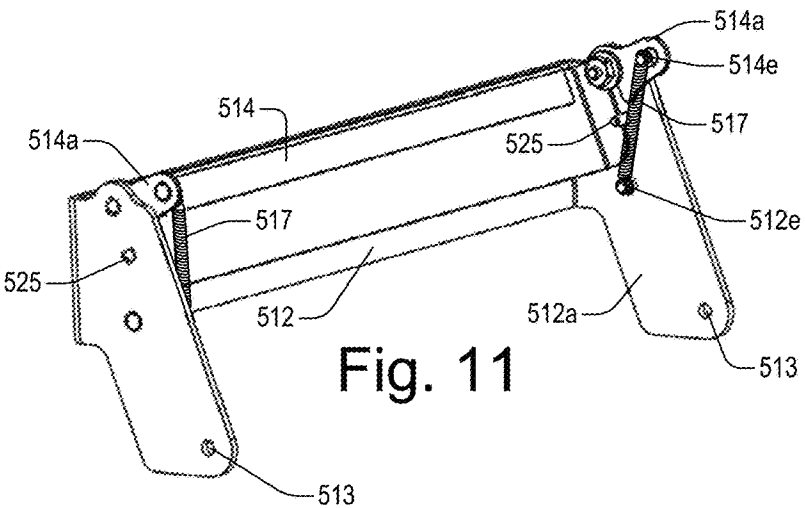
FIG. 11 illustrates a rear perspective view of the access panel assembly 510 of FIG. 10.
Figure 10:
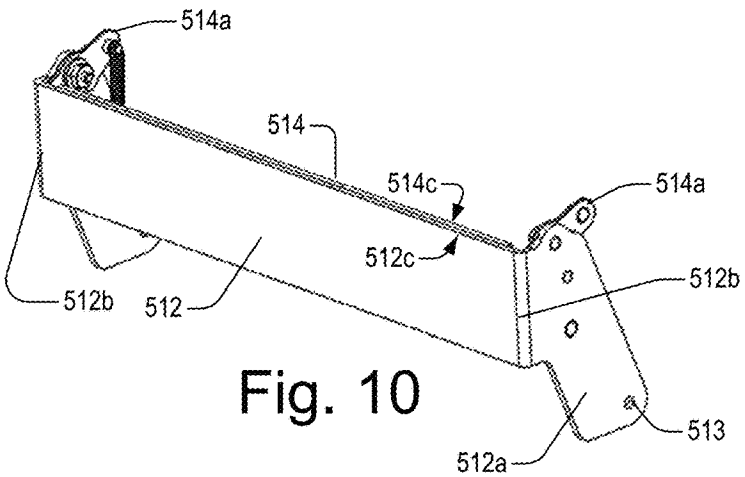
FIG. 10 illustrates a front perspective view of an access panel assembly 510 that has been configured in a "retracted" position in which the position of the upper edge portion (e.g., 514*c*) of the safety bar component 514 is substantially even or substantially level with the upper edge portion (e.g., 512*c*) of the security plate component 512.

Additionally, in at least one embodiment, the safety bar component 514 is movably attached to the security plate component 512 in a manner such that the safety bar component 514 is movable to a "retracted" position, whereby the upper edge or lip portion (e.g., 514*c*) of the safety bar component 514 is positioned such that it does not extend beyond the upper edge portion (e.g., 512*c*) of the security plate component 512, as illustrated, for example, in FIGS. 10 and 11.

FIG. 10 illustrates a front perspective view of an access panel assembly 510 that has been configured in a "retracted" position in which the position of the upper edge portion (e.g., 514*c*) of the safety bar component 514 is substantially even or substantially level with the upper edge portion (e.g., 512*c*) of the security plate component 512.

FIG. 11 illustrates a rear perspective view of the access panel assembly 510 of FIG. 10.

In the specific example embodiments of FIGS. 8-11, pin members 512*d* serve as fulcrums or pivot points about which the safety bar component 514 may rotatably move or pivot between its extended position (FIG. 9) and its retracted position (FIG. 11).

In at least one embodiment, the access panel assembly 510 may be configured or designed such that the "default" or "resting" configuration of the safety bar component 514 corresponds to its extended position. According to different embodiments, this may be achieved using various mechanical mechanisms such as, for example, spring mechanisms, cantilevered counterweight mechanisms, and the like. For example, as illustrated in the example embodiment of FIG. 9, one or more spring component(s) (e.g., 517) may be coupled to respective anchor pins (e.g., 514*e* and 512*e*). The tension of the spring component(s) 517 exert downward forces on cantilevered arm portions 514*a*, thereby causing the front portion (e.g., 514*c*) of the safety bar component to move upward into its extended position (FIG. 9).

In at least one embodiment, the access panel assembly 510 is configured or designed to enable the safety bar component 514 to be manually moved to a retracted position, for example, by manually exerting downward force or pressure (e.g., by human operator's hand) on the upper edge portion 514*c* of the safety bar component. For example, a human operator may use his/her hand to push down on the safety bar component to cause the safety bar component to move into its retracted position (FIG. 11). As illustrated in the example embodiment of FIG. 11, pin(s) 525 may function as a stopping or limiting mechanism for limiting the range of movement of the safety bar component.

According to different embodiments, the access panel assembly 510 may be configured or designed such that a specified minimum or threshold amount of force may be required to be exerted on the safety bar component to cause the safety bar component to move into its retracted position. For example, according to different embodiments, the minimum or threshold amount of force may correspond to a specific amount of force selected from a range of values such as, for example, 3 ounces-16 ounces, 1 netwon-4 newtons, etc. For example, in one embodiment, the specified minimum or threshold amount of force may be equal to about 8 ounces. In another embodiment, the specified minimum or threshold amount of force may be equal to about 2 newtons.

In at least one embodiment, when the downward force on the safety bar component stops being exerted, the spring mechanism (e.g., 517) causes the safety bar component 514 to automatically move back into its extended position.

Figure 25:
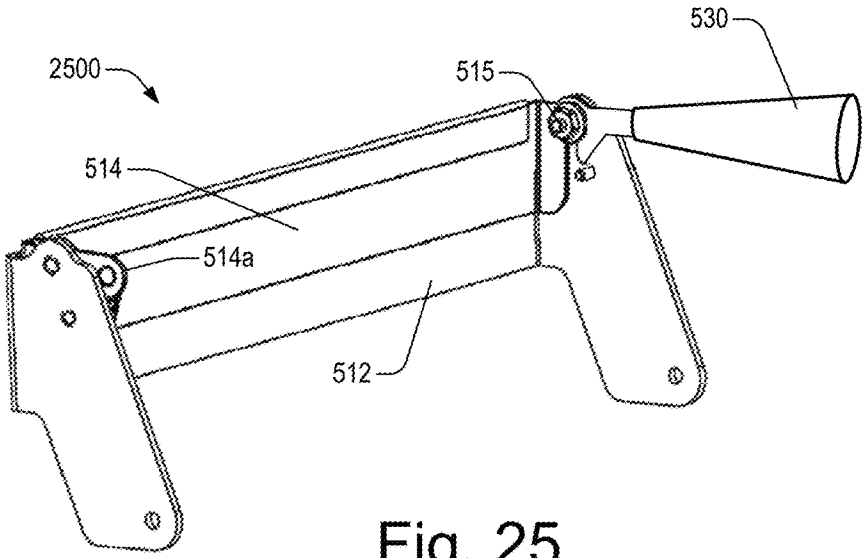
FIG. 25 illustrates a rear perspective view of an alternate embodiment of an access panel assembly 2500 which utilizes at least one cantilevered counterweight component 530 which is configured or designed to cause the safety bar component 514 to automatically return to its extended position.

It will be appreciated that other types of mechanical mechanisms (e.g., other than spring-type mechanisms) may also be used to cause the safety bar component 514 to automatically move back into its extended position. For example, FIG. 25 illustrates a rear perspective view of an alternate embodiment of an access panel assembly 2500 which utilizes at least one cantilevered counterweight component 530 which is configured or designed to cause the safety bar component 514 to automatically return to its extended position.

Figure 7:
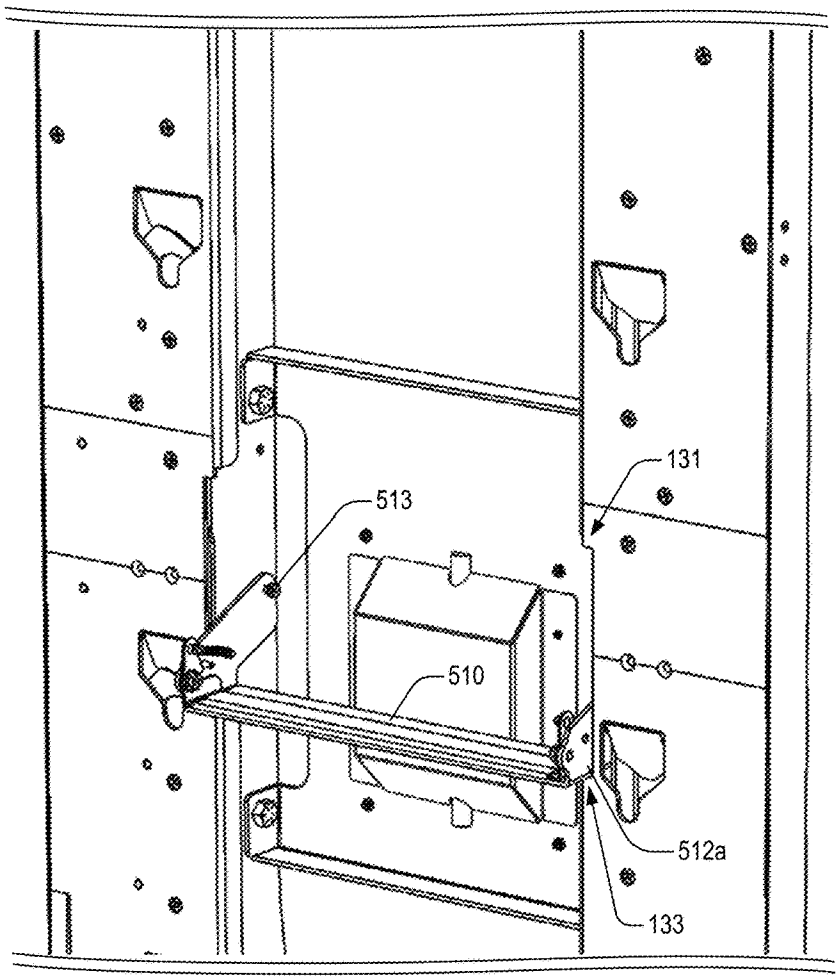
FIG. 7 illustrates a front perspective view of an access panel assembly 510 which is positioned in a "fully open" configuration.

In at least one embodiment, the access panel assembly 510 is movably or pivotably attached to the display support frame 130 via fasteners (e.g., 513*a*, FIG. 5) which engage with mounting holes (e.g., 513, FIG. 8) of the access panel assembly, thereby enabling the access panel assembly 510 to be movable between a "closed" configuration (e.g., FIG. 5) and an "open" configuration (e.g., FIG. 7).

Figure 28:
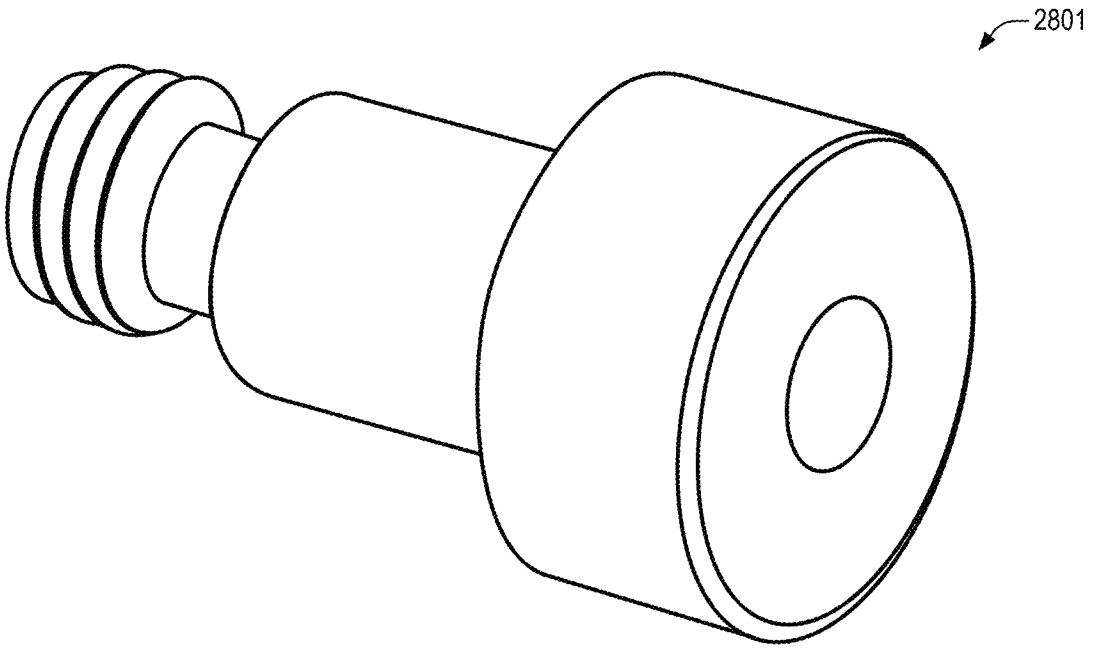
FIG. 28 shows an example embodiment of one type of fastener which may be utilized in one or more embodiments disclosed herein.
Figure 29:
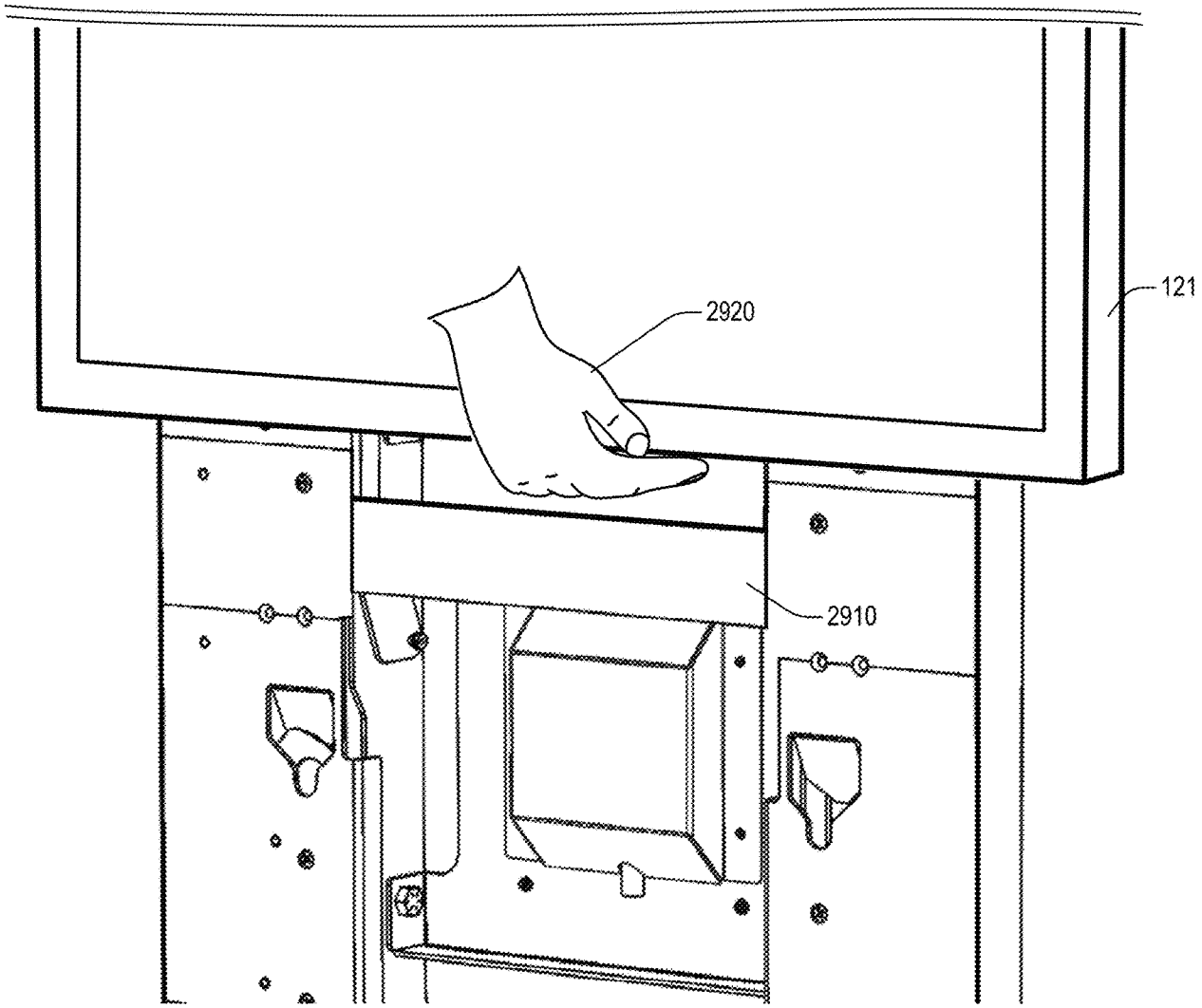
FIG. 29 shows an example embodiment of portions of an electronic gaming device which includes a display device support frame comprising a security plate component 2910.

In at least one embodiment, fasteners 513*a* may be implemented using shoulder screw(s) such as, for example, shoulder screw 2801 of FIG. 28. In one embodiment, one or more of the shoulder screws may be configured or designed in accordance with the following specifications: 8-32 thread, 3/16 inch shoulder, 1/4 inch shoulder length. Other types of fasteners which may be used may include, but are not limited to, one or more of the following (or combinations thereof): screws, bolts, pins, rivets, and/or other types of fasteners which may be used to attach the access panel assembly to the display support frame and allow pivoting of the access panel assembly.

FIG. 5 illustrates a front perspective view of an access panel assembly that is movably or pivotably attached to the display support frame 130 via fasteners 513*a* which engage with mounting holes 513. As illustrated in the example embodiment of FIG. 5, the access panel assembly is configured in a "closed" configuration which provides desired cabinet/game security.

In the specific example embodiment of FIG. 5, the access panel assembly is movably or pivotably attached to the display support frame 130 via shoulder screw fasteners (e.g., 513*a*) which are inserted through mounting holes (e.g., 513, FIG. 8) of the access panel assembly, and securely screwed into respective apertures (e.g., threaded holes) of the display support frame in a manner which enables the access panel assembly 510 pivot about the fasteners 513*a* and to be movable between a "closed" configuration and an "open" configuration.

As described in greater detail below (e.g., with respect to FIGS. 20-23), the safety bar component 514 is also configured or designed to function as a latching mechanism for securing the access panel assembly in a closed configuration (FIG. 5), and for enabling the access panel assembly to be unlatched (e.g., by pushing down on safety bar component 514) to allow the access panel assembly to move to an "open" configuration (e.g., FIGS. 6-7).

Figure 22:
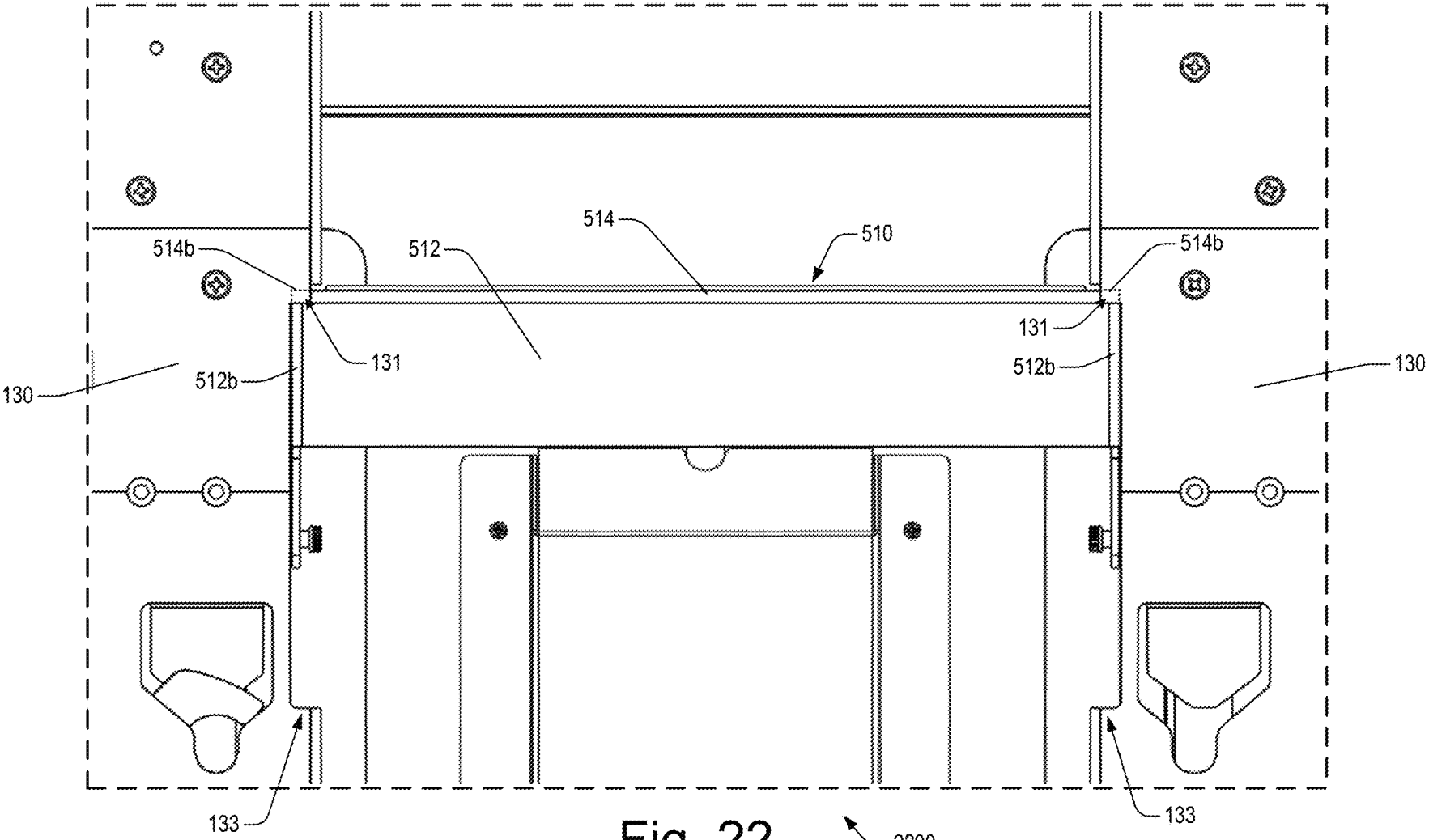
FIG. 22 shows a front elevation view illustrating an example embodiment of a latching mechanism for enabling the access panel assembly 510 to be latched (e.g., in a "closed" configuration) to the display support frame 130.

FIG. 22 shows a front elevation view illustrating an example embodiment of a latching mechanism for enabling the access panel assembly 510 to be latched (e.g., in a "closed" configuration) to the display support frame 130. As illustrated in the example embodiment of FIG. 22, the while the access panel assembly is configured in a "closed" configuration, portions (514*b*) of the safety bar component 514 are positioned behind respective shoulder portions 131 of the display support frame 130. This overlapping configuration of safety bar component portions 514*b* and display support frame portions 131 enables the access panel assembly to be securely latched in its closed configuration. It is also noted in the example embodiment of FIG. 22 that the display support frame portions 131 are configured or designed not to interfere with the movement of the security plate component 512. Additionally, as illustrated in the example embodiment of FIG. 22, display support frame 130 may be configured or designed to include lower shoulder portions 133, which may interface with edge portions 512*b* of the security plate component 512 and serve as "seats" for enabling the access panel assembly 510 to rest in its fully open configuration (e.g., as illustrated in FIG. 7).

Figure 23:
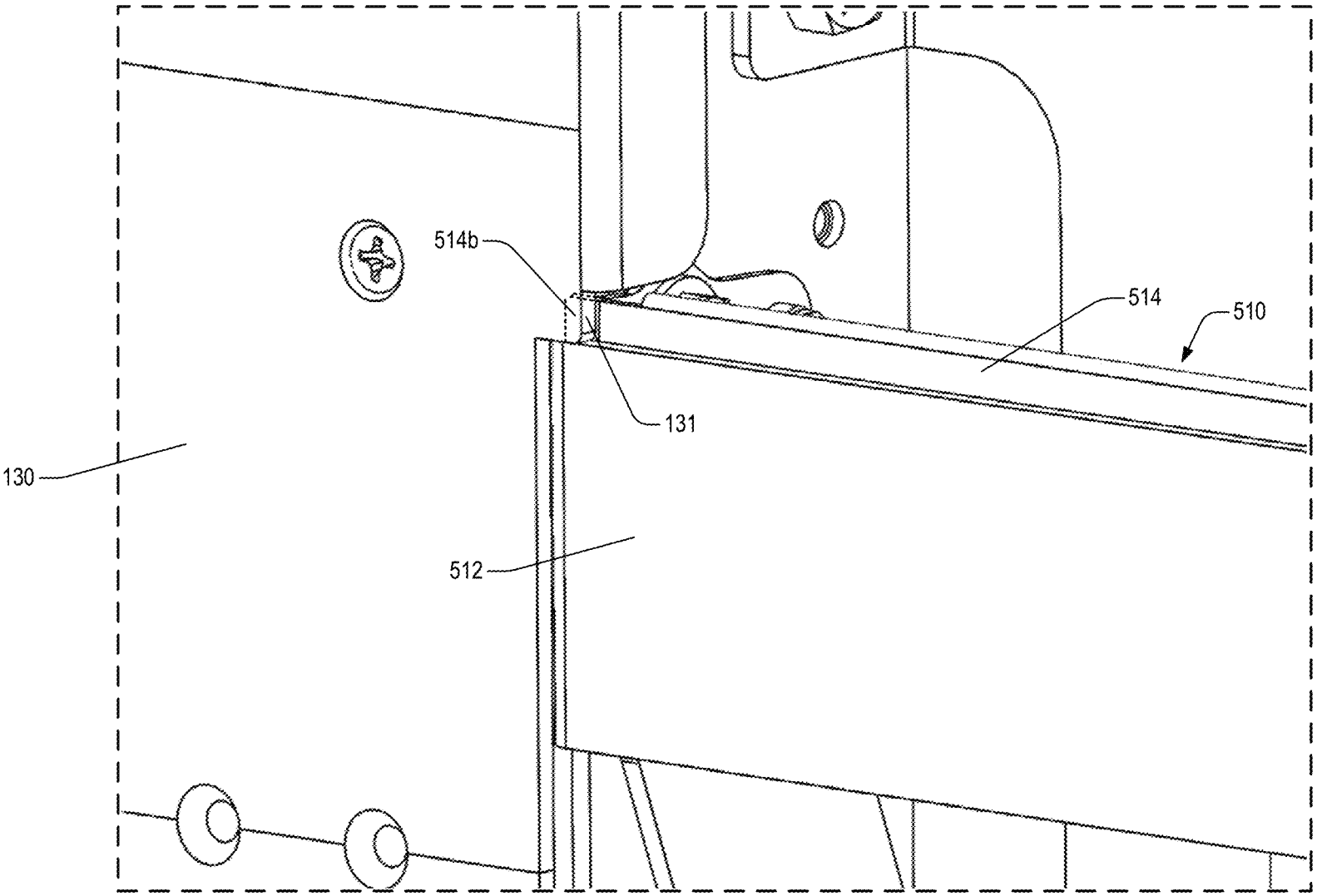
FIG. 23 shows a front perspective view illustrating details of a latching mechanism for enabling the access panel assembly 510 to be securely latched in a closed configuration.

FIG. 23 shows a front perspective view illustrating details of a latching mechanism for enabling the access panel assembly 510 to be securely latched in a closed configuration. As illustrated in the example embodiment of FIG. 23, the while the access panel assembly is configured in a closed configuration, portion 514*b* of the safety bar component 514 is positioned behind shoulder portion 131 of the display support frame 130. This overlapping configuration, along with the structural rigidity of the safety bar component 514 and display support frame 130 enables the access panel assembly to be securely latched in its closed configuration.

In at least one embodiment, the access panel assembly 510 may be unlatched by pushing down on safety bar component 514 to cause it to move from its extended position to its retracted position. For example, referring to FIG. 22, if the access panel assembly 510 is initially configured in its closed configuration, and the safety bar component 514 is subsequently pushed down (e.g., and caused to move to its retracted position), the portions (514*b*) of the safety bar component 514 will be positioned below the respective shoulder portions 131 of the display support frame 130, thereby unlatching the access panel assembly from the display support frame 130, and enabling the access panel assembly to move to an "open" configuration (as illustrated, for example, in FIGS. 6-7).

Figure 6:
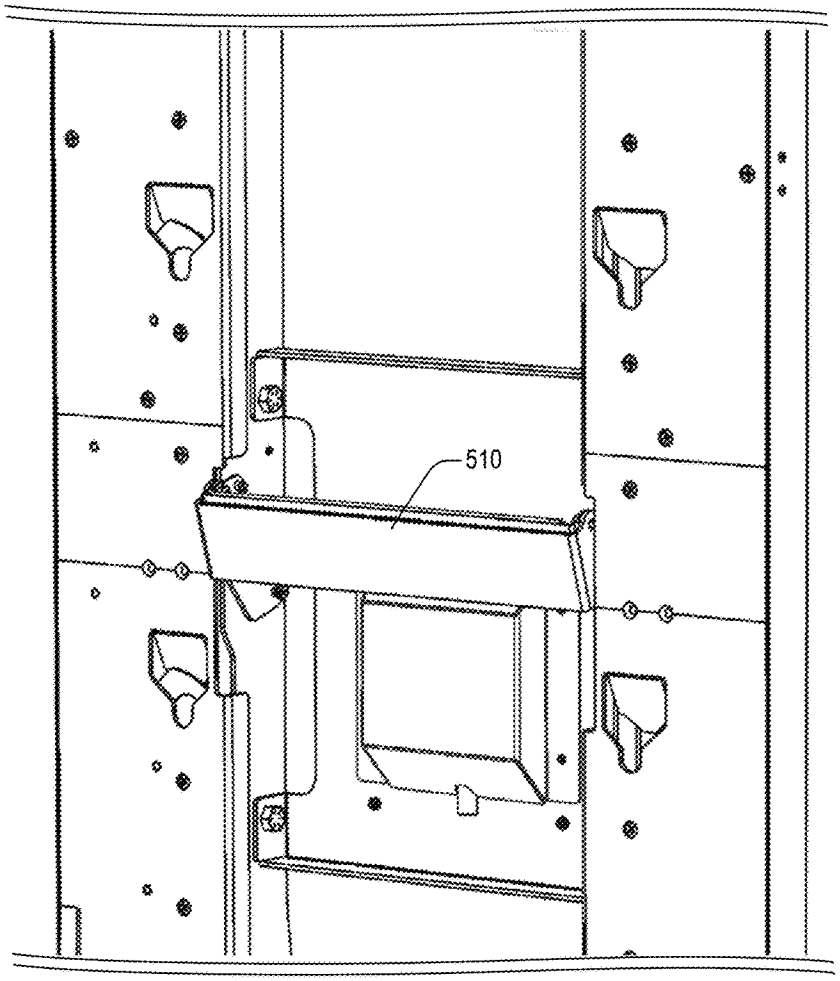
FIG. 6 illustrates a front perspective view of an access panel assembly 510 which is positioned in a "partially open" configuration.

FIG. 6 illustrates a front perspective view of an access panel assembly 510 which is positioned in a "partially open" configuration.

FIG. 7 illustrates a front perspective view of an access panel assembly 510 which is positioned in a "fully open" configuration.

In at least one embodiment, the access panel assembly 510 is configured or designed to operate in a manner such that, when the access panel assembly 510 is initially configured in its closed configuration, and the safety bar component 514 is subsequently pushed down and caused to move to its retracted position, the access panel assembly 510 automatically swings forward (e.g., due to the force of gravity) and moves into its "fully open" configuration (e.g., FIG. 7).

For example, in the example embodiment of FIG. 5, the access panel assembly 510 is movably or pivotably attached to the display support frame 130 via fasteners 513*a* which movably or pivotably attach the security plate component arms 512*a* to the display support frame 130, thereby enabling the access panel assembly 510 to move in an arc-shaped path about pivot points 513*a*, for example, as illustrated by the arc-shaped path 505 (FIG. 5).

As illustrated in the example embodiment of FIG. 5, the access panel assembly 510 is movably or pivotably attached to the display support frame 130 in a manner such that the positions of pivot points 513*a* are laterally displaced from the positions of the security plate component 512 and safety bar component 514. This mounting configuration creates an offset center of gravity of the access panel assembly, wherein the vertical center of gravity of the access panel assembly 510 is not located over the pivot points 513*a*, but rather is located somewhere between security plate component 512 and pivot points 513*a*. As a result, when the access panel assembly 510 is unlatched from the display support frame 130 (e.g., by moving the safety bar component 514 to its retracted position), the offset center of gravity of the access panel assembly causes the access panel assembly 510 automatically swing forward and downward (e.g., due to the force of gravity) in an arc-shaped path into its "fully open" configuration (e.g., FIG. 7).

It will be appreciated that the configuration and/or design of the access panel assembly safety mechanisms provide desirable safety features for reducing or mitigating potential safety hazard issues. For example, in one embodiment where the access panel assembly includes a security plate component but does not include a safety bar component, if the access panel assembly is configured in a closed position during the installation process of one or more of the display devices (e.g., display device 122), the access panel assembly may represent a safety hazard for the installer's fingers/hand. For example, in one possible scenario, while an installer is in the process of mounting display device 122 to the display support frame 130, and he may be required to hold onto the bottom edge of the display device at a location positioned above the access panel assembly. In this scenario, if the display device were to accidentally slip downward with the installer's hand still holding onto the bottom edge, this might result in the installer's fingers being pinched between the bottom edge of the display device and the top edge of the security plate component, causing serious injury to the installers fingers.

However, as described herein, by incorporating safety release mechanisms into the design of the access panel assembly, such types of injuries may be significantly reduced or mitigated. For example, in a second example scenario similar to that described above, the access panel assembly may be configured or designed to include a movable safety bar mechanism similar to that illustrated in FIGS. 8-11. If, during installation/mounting, the display device were to accidentally slip downward with the installers hand still holding onto the bottom edge, the installer's fingers (or other part of the installer's hand) would initially contact and push down on the top edge 514*c* of the safety bar component 514. This, in turn, would cause the safety bar component 514 to move into a retracted position, which would release the latching mechanism and allow the access panel assembly 510 to automatically move forward and downward (e.g., in an arc-shaped path) into its "fully open" configuration (e.g., as illustrated in FIG. 7). This movement the access panel assembly 510 into its fully open configuration helps prevent the installer's fingers (or other body parts) from being being pinched between the bottom edge of the display device and the top edge of the security plate component 512, thereby avoiding serious injury to the installer.

FIG. 12 illustrates a front perspective view of a portion 1200 of a gaming machine cabinet which includes an access panel assembly 510, a display support frame 130, and a display device 122 which has been mounted to the display support frame 130 above the access panel assembly 510. As illustrated in the example embodiment of FIG. 12, the access panel assembly 510 is positioned in a "closed" configuration. In at least one embodiment, the access panel assembly 510 is movably mounted to the display support frame 130 in a manner which enables the access panel assembly 510 to be open and/or closed even while the display device 122 is attached to the display support frame.

Figure 13:
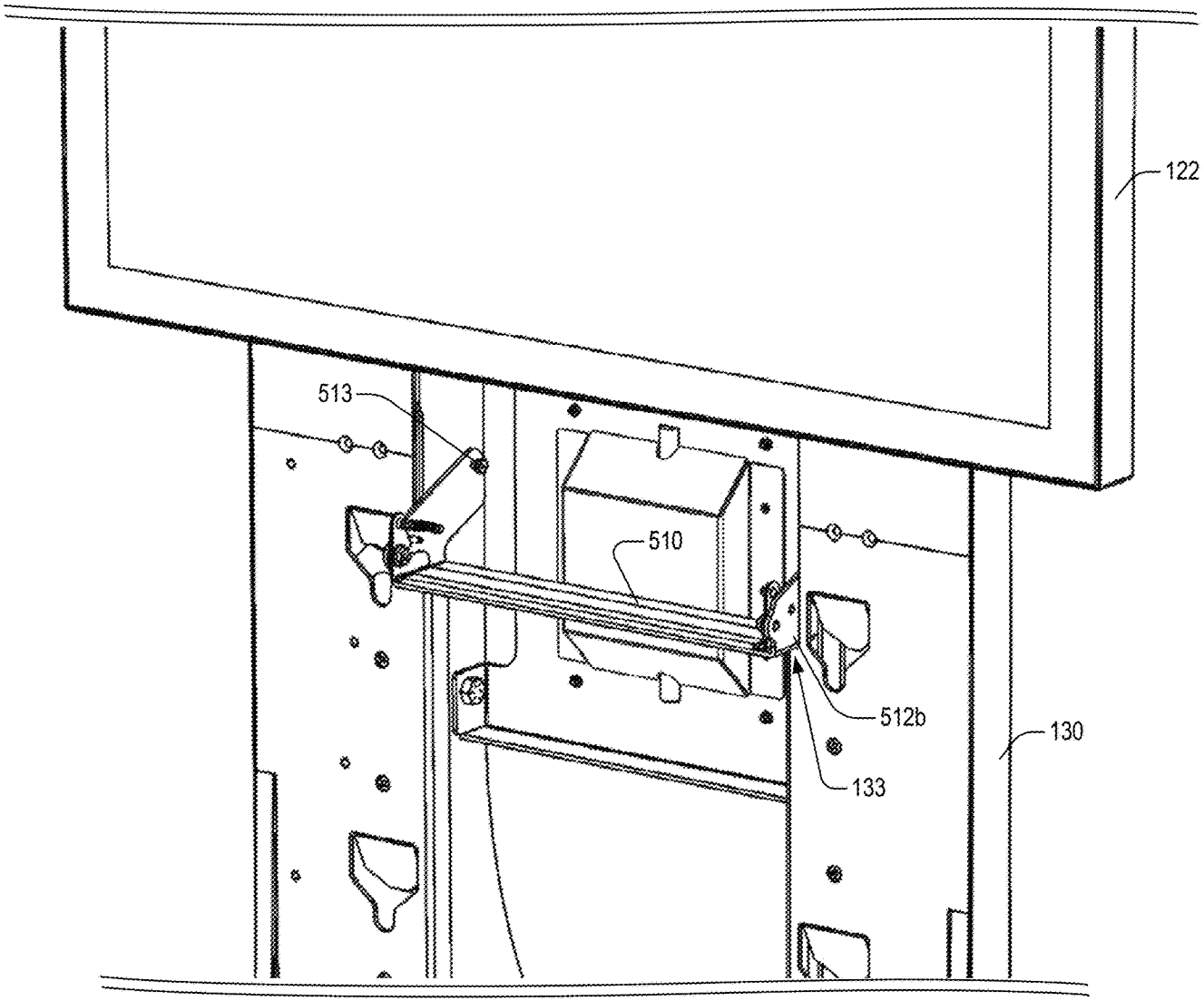
FIG. 13 illustrates a front perspective view of gaming machine cabinet portion 1200 showing the access panel assembly 510 positioned in its "fully open" configuration.

FIG. 13 illustrates a front perspective view of gaming machine cabinet portion 1200 showing the access panel assembly 510 positioned in its "fully open" configuration. As illustrated in the example embodiment of FIG. 13, display support frame 130 includes lower shoulder portions 133, which are configured or designed to interface with edge portions 512*b* of the access panel assembly 510, and to function as "seats" for enabling the access panel assembly 510 to rest in its fully open configuration.

Figure 14:
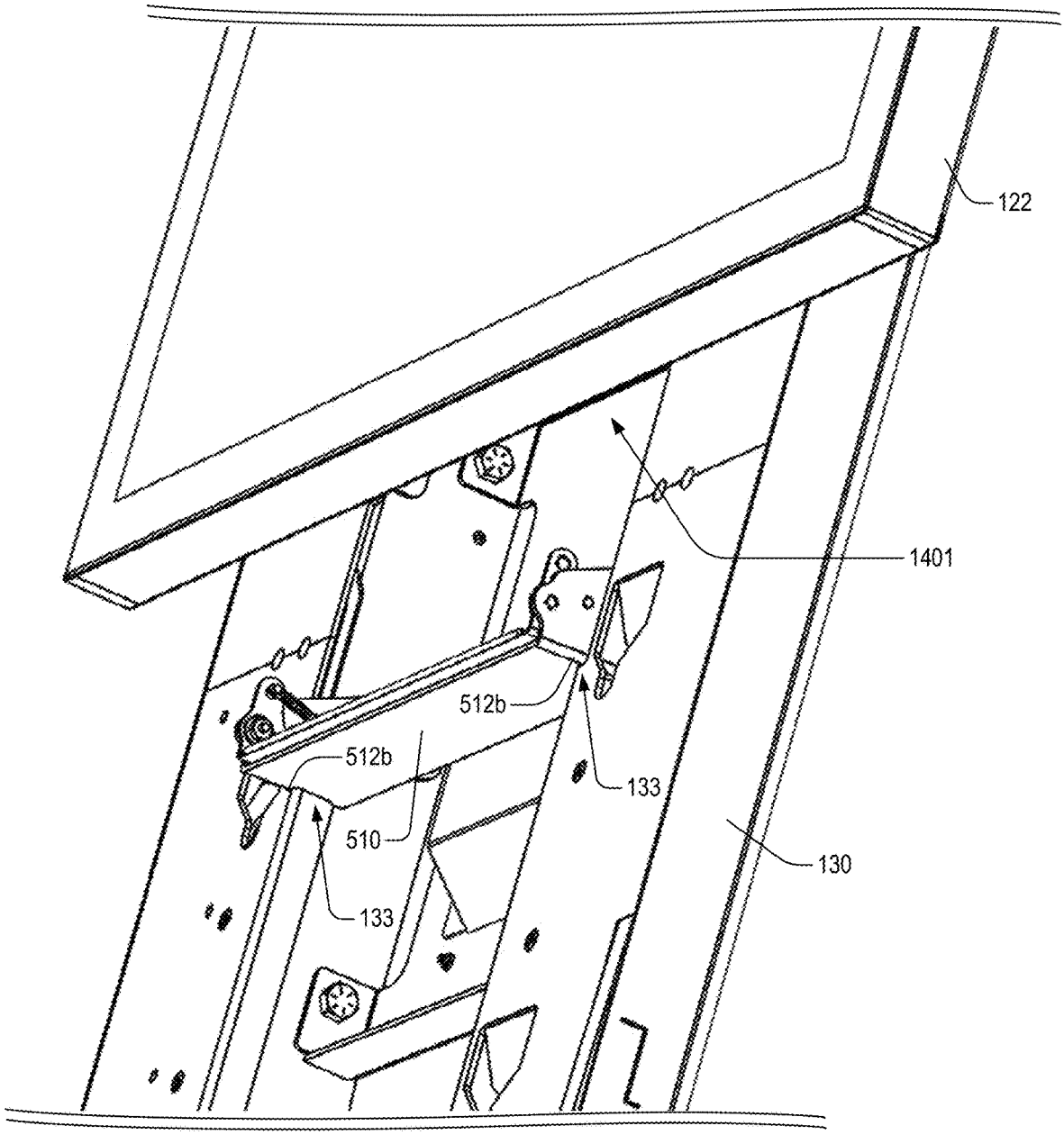
FIG. 14 illustrates an alternate front perspective view of gaming machine cabinet portion 1200 showing the access panel assembly 510 positioned in its "fully open" configuration.

FIG. 14 illustrates an alternate front perspective view of gaming machine cabinet portion 1200 showing the access panel assembly 510 positioned in its "fully open" configuration. As illustrated in the example embodiment of FIG. 14, display support frame 130 includes lower shoulder portions 133, which are configured or designed to interface with edge portions 512*b* of the access panel assembly 510, and to function as "seats" for enabling the access panel assembly 510 to rest in its fully open configuration.

In at least one embodiment, the positioning of the access panel assembly 510 into its "fully open" configuration provides access to the external interface(s) of the display device 122. An example of this is illustrated in FIGS. 14 and 15. As illustrated in the example embodiment of FIG. 14, when the access panel assembly 510 positioned in its "fully open" configuration, access is provided to cavity portion 1401, which may be used to obtain access to the external interface(s) of the display device 122.

FIG. 15 illustrates a bottom perspective view of gaming machine cabinet portion 1200 showing the access panel assembly 510 positioned in its "fully open" configuration. As illustrated in the example embodiment of FIG. 15, the positioning of the access panel assembly 510 into its "fully open" configuration provides direct access to the external interface(s) 1510 of the display device 122.

In at least one embodiment, the gaming machine cabinet may be configured or designed such that some or all of the display devices (e.g., 122 and/or 124) which are mounted to the display support frame 130 are prevented from being removed or unmounted from the display support frame while the access panel assembly 510 is positioned in its closed configuration. In some embodiments, the gaming machine cabinet may be configured or designed such that display device(s) are prevented from being mounted and/or unmounted to/from the display support frame 130 while the access panel assembly 510 is positioned in its closed configuration. In some embodiments, the gaming machine cabinet may be configured or designed such that display device(s) are able to be mounted and/or unmounted to/from the display support frame 130 while the access panel assembly 510 is positioned in its fully open configuration.

FIGS. 16-20 depict a sequence of drawings illustrating details of how the access panel assembly 510 may be moved from a fully open configuration (FIG. 16) to a closed configuration (FIG. 20), in accordance with one embodiment.

Figure 16:
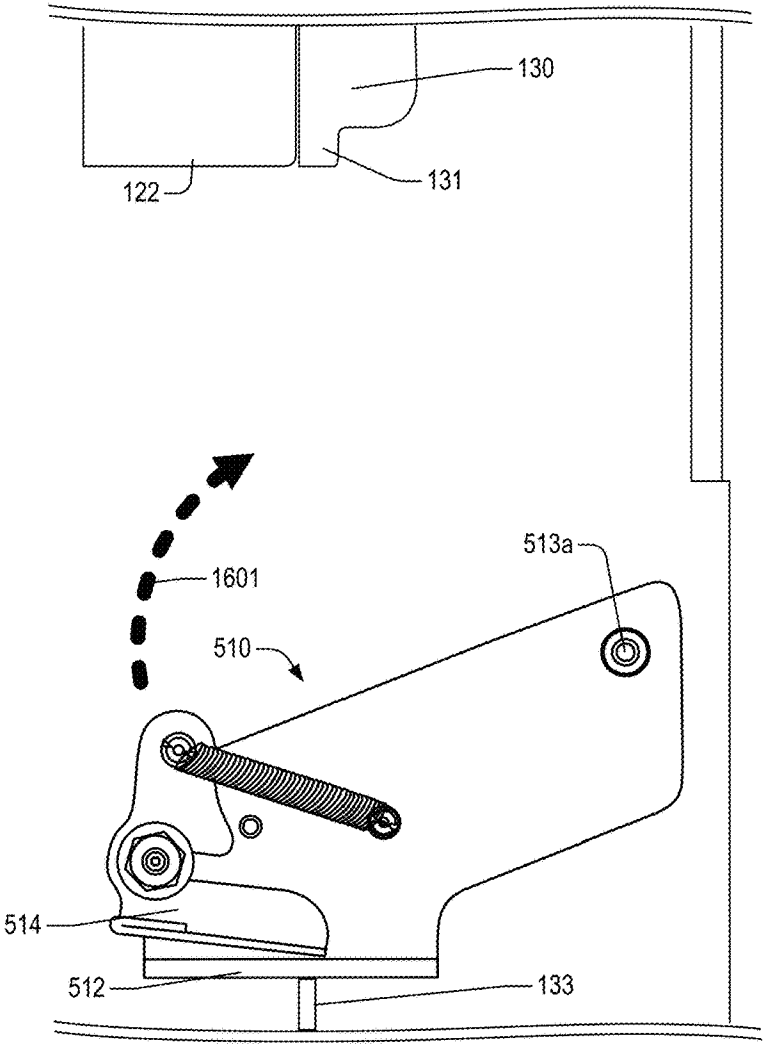
Figure 19:
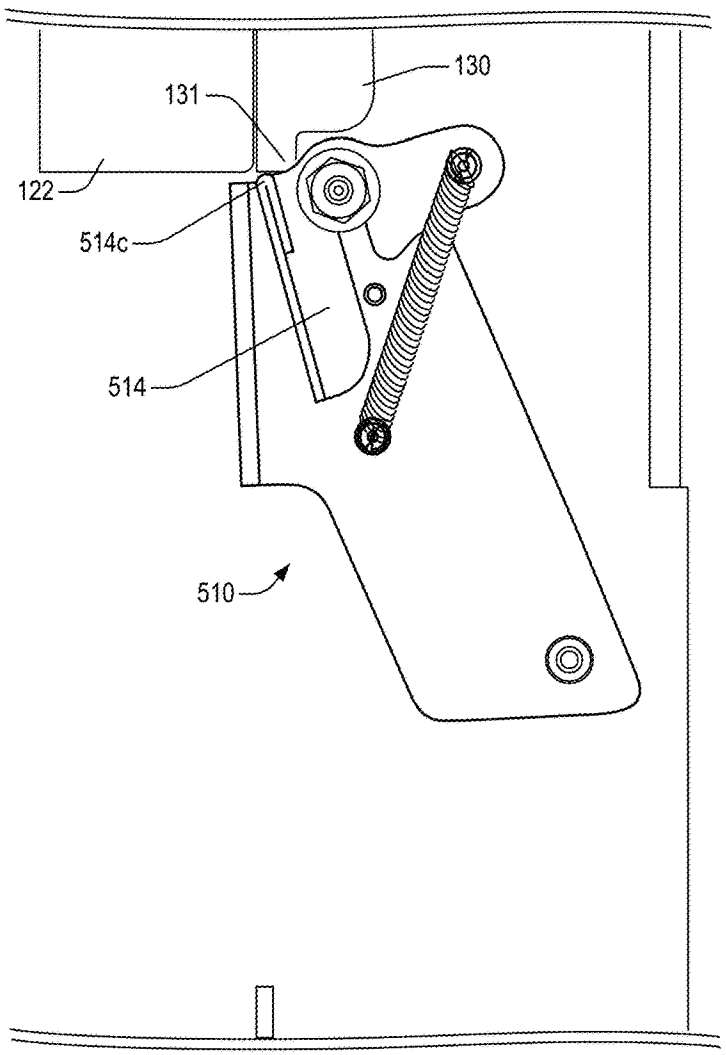

FIG. 16 illustrates a cut-away side view of a portion 1600 of gaming machine cabinet components, including, for example, access panel assembly 510, display support frame 130 (including portions 131 and 133), and display device 122. In the example embodiment of FIG. 16, the access panel assembly 510 is shown positioned in its fully open configuration. As illustrated in the example embodiment of FIG. 16, the security plate component 512 is seated on seat portion(s) 133 of the display support frame, and the safety bar component 514 is in its extended position. Additionally, in this example embodiment, it is assumed that monitor 122 is mounted to display support frame 130.

In at least one embodiment, the access panel assembly 510 may be manually moved from its fully open configuration to its closed configuration, for example, by pushing upwards on the access panel assembly. In at least one embodiment, as the access panel assembly is moved into its closed configuration, the access panel assembly may move in an arc-shaped path (e.g., about pivot point 513*a*) as indicated by directional arrow 1601.

Figure 17:
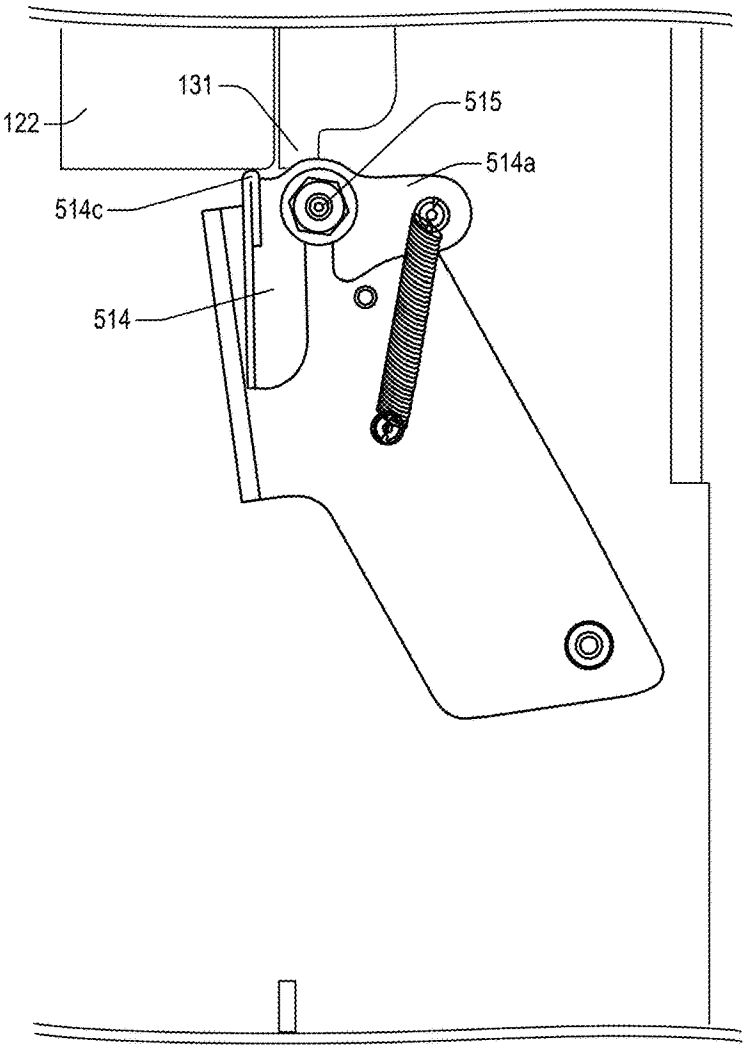
FIGS. 16-20 show a sequence of drawings illustrating details of how the access panel assembly 510 may be moved from a fully open configuration (FIG. 16) to a closed configuration (FIG. 20), in accordance with one embodiment.

As the access panel assembly continues to move towards its closed configuration, the upper edge portion 514*c* of the safety bar component may make contact with the lower edge of display device 122, as illustrated, for example, in FIG. 17. Thereafter, as the access panel assembly continues to move towards its closed configuration and continues to make contact with the lower edge of display device 122, the safety bar component 514 is caused to at least partially retract, as illustrated, for example, in FIG. 18. In other embodiments where display device 122 is not yet installed are mounted to the display support frame, the access panel assembly may continue along its arced path until the safety bar component 514 makes contact (or engages with) shoulder portion(s) 131 of the display support frame.

Figure 18:
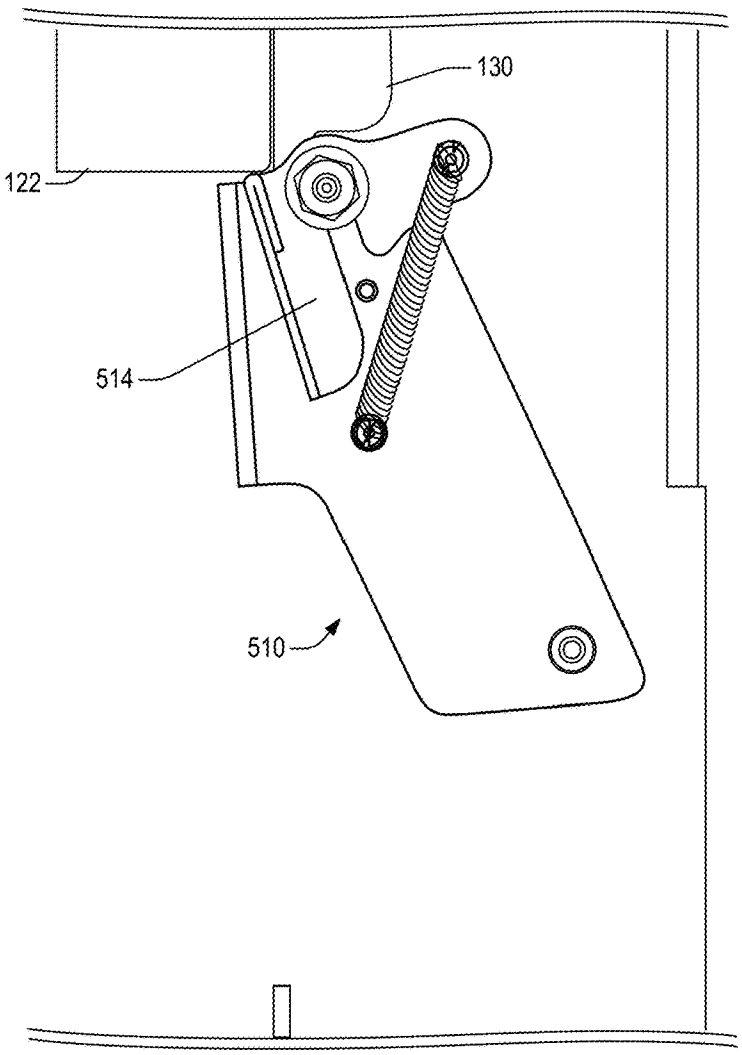

For example, referring to the example embodiment of FIG. 18, as the access panel assembly 510 is moved towards its closed configuration, the top edge portion 514*c* of the safety bar component is caused to make contact with shoulder portion(s) 131 of the display support frame. Thereafter, as the access panel assembly continues to move towards its closed configuration and continues to make contact with shoulder portion(s) 131 of the display support frame, the safety bar component 514 is caused to at least partially retract, as illustrated, for example, in FIG. 18.

In at least one embodiment, once the upper edge portion 514*c* of the safety bar component has moved (e.g., in its partially retracted position) past the physical boundary of display support frame shoulder portion(s) 131 and ceases to engage with the shoulder portion(s) 131, the spring mechanism 517 of the access panel assembly 510 may cause the safety bar component 514 to automatically move back into its extended position, as illustrated, for example, in FIG. 20. In at least one embodiment, this movement of the safety bar component 514 to its extended position functions a latching mechanism to securely latch the access panel assembly 510 to the display support frame 130 in a closed configuration.

FIG. 20 illustrates a cut-away side view of gaming machine cabinet portion 1600 in which the access panel assembly 510 is shown positioned in its closed and latched configuration. As illustrated in the example embodiment of FIG. 20, the safety bar component 514 is in its extended position and functions a latching mechanism to securely latch the access panel assembly 510 to the display support frame 130.

Figure 21:
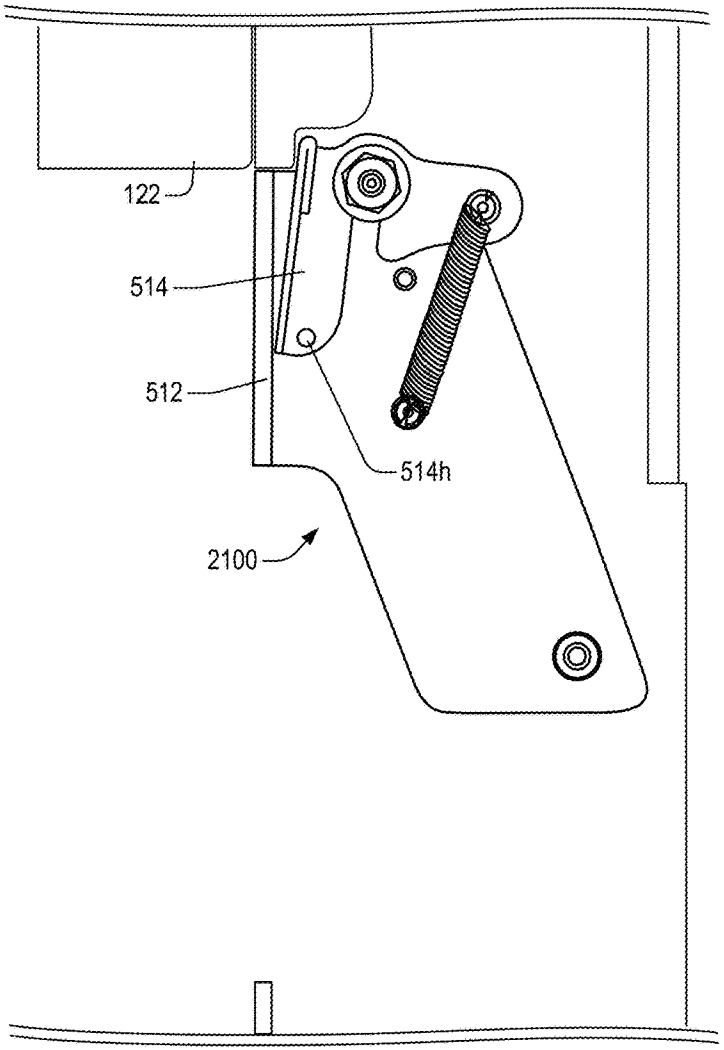
FIG. 21 illustrates an alternate embodiment of an access panel assembly 2100.

FIG. 21 illustrates an alternate embodiment of an access panel assembly 2100. In at least one embodiment, the design of access panel assembly 2100 is substantially similar to access panel assembly 510 of FIG. 20. However, as illustrated in the example embodiment of FIG. 21, the access panel assembly 2100 includes a handle component 514*h* which is configured or designed to facilitate opening of the access panel assembly 2100 from its closed configuration while the upper monitor installed.

Figure 26:
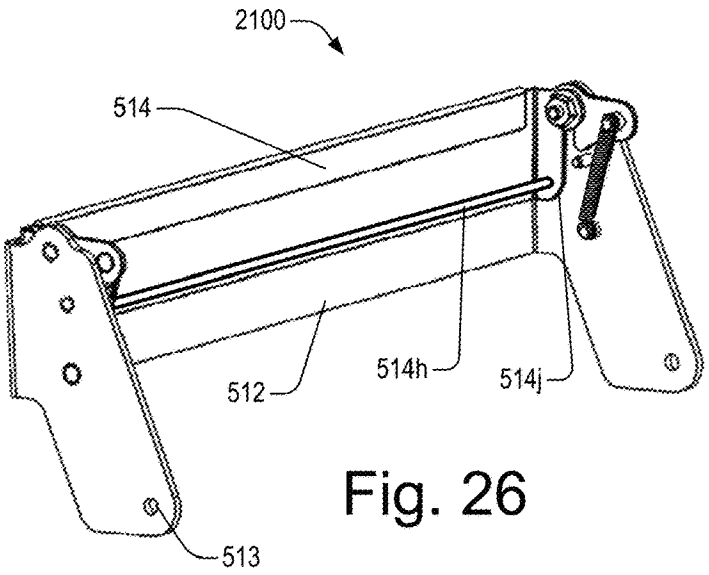
FIG. 26 illustrates a rear perspective view of the access panel assembly embodiment 2100.

FIG. 26 illustrates a rear perspective view of the access panel assembly 2100. As illustrated in the example embodiment of FIG. 26, safety bar component 514 includes a handle component 514*h* which is configured or designed to facilitate opening of the access panel assembly 2100 (e.g., from its closed configuration while the upper monitor installed). For example, in one embodiment, with the access panel assembly 2100 in a closed configuration, and upper monitor installed, a human operator or technician may access or grab handle component 514*h*, for example, by reaching his or her hand under the lower edge of security plate component 512. The operator/technician may then pull downward on the handle component 514*h* in order to cause safety bar component 514 to move into its retracted position, thereby causing the access panel assembly 2100 to unlatch from display support frame 130 and move to an open configuration. As illustrated in the example embodiment of FIG. 26, handle component 514*h* may be implemented as a rod or bar which is attached to arm portions 514*j* of the safety bar component. In other embodiments (not shown) handle component may be implemented using other designs which facilitate opening of the access panel assembly 2100 from its closed configuration while the upper monitor installed.

It will be appreciated that one advantageous feature of the inventive access panel assembly described herein is that it is configured or designed to be devoid of exposed fasteners when incorporated into gaming machines deployed in the field. That is, for example, when the access panel assembly is configured in its closed position and display devices 122 and 124 are mounted to the display support frame 130, no external fasteners are exposed at the exterior surfaces of the access panel assembly.

Additional advantageous features of the inventive access panel assembly include, but are not limited to, one or more of the following (or combinations thereof):

- Its design and operation allows for it to be utilized in multi-monitor gaming cabinet designs (e.g., such as that illustrated in FIGS. 1-2) in a manner which minimizes the vertical spacing between the upper and lower display devices, which is desirable for aesthetic considerations.
- Integration of the access panel assembly into gaming cabinet designs provides additional safety features and helps minimize or reduce injuries.
- The access panel assembly includes a movable safety bar mechanism, which, when deployed or moved, causes the access panel assembly to automatically open.
- The access panel assembly design incorporates an automated latching mechanism which enables the access panel assembly to be securely latched in a closed position. Additionally, in at least one embodiment, the latching mechanism is configured or designed function properly even when the upper monitor is installed or mounted to the display support frame.
- The access panel assembly can be moved to the closed position after the upper monitor is in place.

Additional Electronic Gaming Machine Components/Features

At least some of the EGM embodiments disclosed herein may also include a player tracking module. In one embodiment, the player tracking module may include a key pad for entering player tracking information, a display for displaying player tracking information, and a card reader or RFID reader for entering a magnetic striped card or RFID card containing player tracking information. In at least some embodiments, EGM 100 also includes a bill validator and ticket printer, which are both securely disposed within the interior of EGM cabinet.

In at least some embodiments, the EGM may include one or more interfaces configured or designed to provide player tracking services and other game services to a player playing a game on the EGM. For example, in one embodiment, one or more EGM interfaces may be configured or designed to facilitate, enable, initiate, and/or perform one or more of the following: 1) input player tracking identification information, 2) view account information and perform account transactions for accounts such as player tracking accounts and bank accounts, 3) receive operating instructions, 4) redeem prizes or comps including using player tracking points to redeem the prize or comp, 5) make entertainment service reservations, 6) transfer credits to cashless instruments and other player accounts, 7) participate in casino promotions, 8) select entertainment choices for output via video and audio output mechanisms, 9) play games and bonus games, 10) request gaming services such as drink orders, 11) communicate with other players or casino service personnel and 12) register a player for a loyalty program such as a player tracking program. In addition, in at least some embodiments, one or more EGM interfaces may be used by casino service personnel to: a) access diagnostic menus, b) display player tracking unit status information and EGM status information, c) access EGM metering information and d) display player status information.

Many different types of games, including mechanical slot games, video slot games, video poker, video blackjack, video pachinko and lottery, may be provided on EGM 100. The EGM 100 is operable to provide play of many different instances of games of chance. The instances may be differentiated according to themes, sounds, graphics, type of game (e.g., slot game vs. card game), denomination, number of paylines, maximum jackpot, progressive or non-progressive, bonus games, etc. The EGM may be operable to allow a player to select a game of chance to play from a plurality of instances available on the EGM. For example, the EGM may provide a menu with a list of the instances of games that are available for play on the EGM and a player may be able to select from the list a first instance of a game of chance that they wish to play.

The various instances of games available for play on an EGM may be stored as game software on a mass storage device in the EGM or may be generated on a remote EGM but then displayed on the EGM. The EGM may execute game software, such as but not limited to video streaming software that allows the game to be displayed on the EGM. When an instance is stored on the EGM, it may be loaded from the mass storage device into a RAM for execution. In some cases, after a selection of an instance, the game software that allows the selected instance to be generated may be downloaded from a remote EGM, such as another EGM.

Understand that EGM 100 is but one example from a wide range of EGMs on which the present invention may be implemented. Also, a game may be generated on a host computer and may be displayed on a remote terminal or a remote EGM. The remote EGM may be connected to the host computer via a network of some type such as a local area network, a wide area network, an intranet or the Internet, by a wired or wireless connection. The remote EGM may be a portable EGM such as but not limited to a cell phone, a personal digital assistant, and a wireless game player. Images rendered from 3-D gaming environments may be displayed on portable EGMs that are used to play a game of chance. Further, an EGM or server may include gaming logic for commanding a remote EGM to render an image from a virtual camera in a 3-D gaming environment stored on the remote EGM and to display the rendered image on a display located on the remote EGM. Thus, those skilled in the relevant art will understand that the present invention, as described below, can be deployed on most any EGM now available or hereafter developed.

Some EGMs are implemented with special features and/or additional circuitry that differentiates them from general-purpose computers (e.g., desktop personal computers and laptops). EGMs are highly regulated to ensure fairness and, in many cases, EGMs are operable to dispense monetary awards of multiple millions of dollars. Therefore, to satisfy security and regulatory requirements in a gaming environment, hardware and software architectures may be implemented in EGMs that differ significantly from those of general-purpose computers. A description of EGMs relative to general-purpose computing machines and some examples of the additional (or different) components and features found in EGMs are described below.

At first glance, one might think that adapting PC technologies to the gaming industry would be a simple proposition because both PCs and EGMs employ microprocessors that control a variety of devices. However, because of such reasons as 1) the regulatory requirements that are placed upon EGMs, 2) the harsh environment in which EGMs operate, 3) security requirements, and 4) fault tolerance requirements, adapting PC technologies to an EGM can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in an EGM because in an EGM these faults can lead to a direct loss of funds from the EGM, such as stolen cash or loss of revenue when the EGM is not operating properly.

For the purposes of illustration, a few differences between PC systems and gaming systems will be described. A first difference between EGMs and common PC based computers systems is that EGMs are designed to be state-based systems. In a state-based system, the system stores and maintains its current state in a non-volatile memory, such that, in the event of a power failure or other malfunction the EGM will return to its current state when the power is restored. For instance, if a player was shown an award for a game of chance and, before the award could be provided to the player the power failed, the EGM, upon the restoration of power, would return to the state where the award is indicated. This requirement affects the software and hardware design on an EGM. As anyone who has used a PC knows, PCs are not state machines and a majority of data is usually lost when such a malfunction occurs.

A second important difference between EGMs and common PC based computer systems relates to security features. For example, in the heavily regulated field of wager-based gaming, EGMs and their associated peripheral devices are required to be compliant with rigorous wager-based gaming regulatory standards. Such gaming regulatory standards often include detailed provisions specifying security standards which must be satisfied and/or maintained with respect to the EGM and its components, particularly those components located at the interior of the EGM, such as, for example, processors, memory, ticket dispensers, bill validators, and the like. In order for gaming manufacturers to comply with such security standards, it is important that their EGM design(s) provide adequate security mechanisms to monitor and control authorized access to the EGM's components, particularly the components located at the interior of the EGM. Additionally, it is important that their EGM design(s) provide adequate security mechanisms to detect and prevent unauthorized access to (and prevent tampering with) the EGM's components, particularly the components located at the interior of the EGM.

Another important difference between EGMs and common PC based computer systems is that for regulation purposes, the software on the EGM used to generate the game of chance and operate the EGM has been designed to be static and monolithic to prevent cheating by the operator of the EGM. For instance, one solution that has been employed in the gaming industry to prevent cheating and satisfy regulatory requirements has been to manufacture an EGM that can use a proprietary processor running instructions to generate the game of chance from an EPROM or other form of nonvolatile memory. The coding instructions on the EPROM are static (non-changeable) and must be approved by a gaming regulator in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burned, approved by the gaming jurisdiction and installed on the EGM in the presence of a gaming regulator. Regardless of whether the EPROM solution is used, to gain approval in most gaming jurisdictions, an EGM must demonstrate sufficient safeguards that prevent an operator or player of an EGM from manipulating hardware and software in a manner that gives them an unfair and in some cases an illegal advantage. The EGM should have a means to determine if the code it will execute is valid. If the code is not valid, the EGM must have a means to prevent the code from being executed. The code validation requirements in the gaming industry affect both hardware and software designs on EGMs.

A third important difference between EGMs and common PC based computer systems is that the number and kinds of peripheral devices used on an EGM are not as great as on PC based computer systems. Traditionally, in the gaming industry, EGMs have been relatively simple in the sense that the number of peripheral devices and the number of functions of the EGM have been limited. Further, in operation, the functionality of EGMs were relatively constant once the EGM was deployed, i.e., new peripherals devices and new gaming software were infrequently added to the EGM. This differs from a PC where users will buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on an EGM, EGMs still have unique device requirements that differ from a PC, such as device security requirements not usually addressed by PCs. For instance, monetary devices, such as coin dispensers, bill validators, ticket printers and computing devices that are used to govern the input and output of cash to an EGM have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory. Additionally, at least some EGM embodiments may be configured or designed to include unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

In at least some embodiments, the serial interfaces may be used to transmit information using communication protocols that are unique to the gaming industry. For example, SAS is a communication protocol used to transmit information, such as metering information, from an EGM to a remote device. Often SAS is used in conjunction with a player tracking system.

In at least some embodiments, the EGM may be treated as peripheral devices to a casino communication controller and connected in a shared daisy chain fashion to a single serial interface. The peripheral devices may preferably be assigned device addresses. In some embodiments, the serial controller circuitry may be configured or designed to implement a method to generate or detect unique device addresses. General-purpose computer serial ports are not able to do this.

The EGM may also include switch based security monitoring circuits and other security monitoring circuits configured or designed to detect intrusion into the EGM by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the EGM can determine whether any security violations occurred while power was off, e.g., via software for reading status registers. This can trigger event log entries and further data authentication operations by the slot machine software.

Trusted memory devices are preferably included as part of the EGM hardware to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents in a separate third party verification device. Once the trusted memory device is verified as authentic, and based on the approval of the verification algorithms contained in the trusted device, the EGM is allowed to verify the authenticity of additional code and data that may be located in the gaming computer assembly, such as code and data stored on hard disk drives.

Mass storage devices used in a general purpose computer typically allow code and data to be read from and written to the mass storage device. In an EGM environment, modification of the gaming code stored on a mass storage device is strictly controlled and would only be allowed under specific maintenance type events with electronic and physical enablers required. Though this level of security could be provided by software, EGMs which include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

In at least one embodiment, at the start of the game, the player may enter playing tracking information via a player tracking interface. Further, other game preferences of the player playing the game may be read from a card inserted into a card reader. During the game, the player views game information using the video display 8. During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input buttons of the Button Panel 110, touchscreen display(s), and/or other devices which enable players to input information into the EGM.

As noted above, one important consideration for casino operators relates to the ability of EGM service technicians to quickly access (e.g., for purpose(s) of servicing, inspecting, repairing, testing, etc.) EGMs (and associated EGM components) deployed in the field. For example, if a component of an EGM (or component thereof) needs to be inspected, serviced, and/or tested, a service technician may be dispatched to the EGM's location (e.g., on the casino floor) in order to perform the desired service/testing/inspection "on site" (e.g., without having to remove the EGM from the casino floor).

Many EGMs typically include some type of Button Panel (e.g., 110, FIG. 1) which is configured or designed to receive various types of input from a player relating to game play activities and/or wagering activities. Different Button Panel embodiments may be configured or designed to include a variety of different mechanical and/or electrical components such as, for example: processors, memory, electrical connectors, mechanical connectors, security mechanisms, mechanical buttons, touchscreens, electronic buttons, sensors, speakers, lights, etc.

Figure 27:
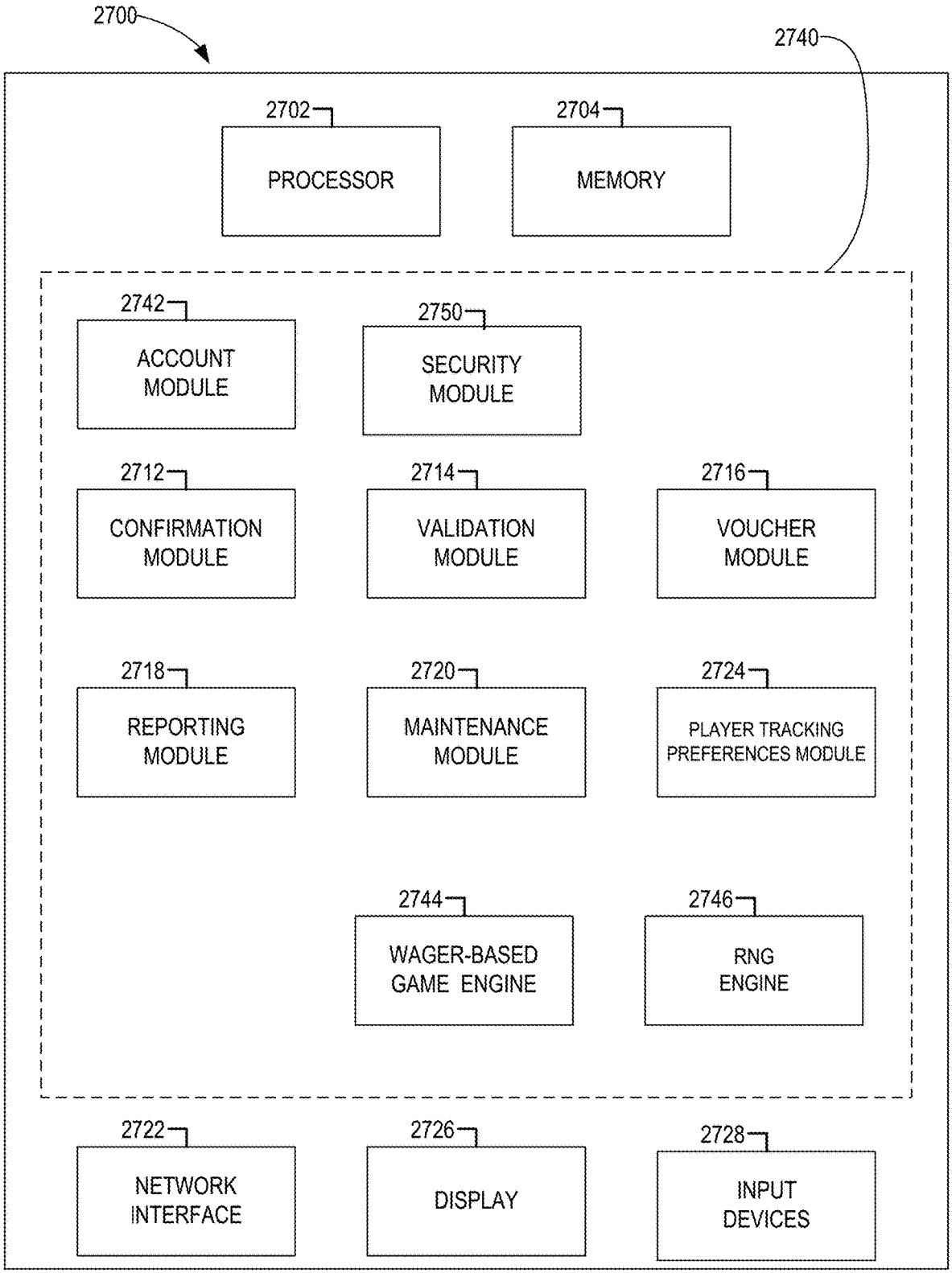
FIG. 27 shows a block diagram 2700 of an electronic gaming device 2700, in accordance with a specific embodiment.

FIG. 27 shows a block diagram 2700 of an electronic gaming device 2700, in accordance with a specific embodiment. Electronic gaming device 2700 may include a processor 2702, a memory 2704, a network interface 2722, input devices 2728, and a display 2726.

Processor 2702 may generate gaming options based on predetermined betting structures and/or outcome categories. Predetermined betting structures may utilize more than one outcome category to generate via processor 2702 gaming options. Predetermined betting structures may combine any outcome category with any other outcome category to gaming options.

Processor 2702 may offer a gaming option which is structured so that the gaming option relates to more than one EGM. Processor 2702 may generate contingent gaming options and/or predetermined gaming options. Contingent gaming options 2710 may include structures such that when a triggering event occurs over one or more than one gaming event, racing event, and/or sporting event, the wager is activated.

Network interface 2722 may include configured or designed to enable electronic gaming device 2700 to communicate with remote devices/systems such as, for example, video/multimedia server(s), accounting/transaction server(s), gaming server(s), authentication server(s), player tracking server(s), voucher server(s), etc.

Input devices 2728 may include mechanical buttons, electronic buttons, a touchscreen, a microphone, cameras, an optical scanner, or any combination thereof. Input devices 2728 may be utilized to make a wager, to make an offer to buy or sell a voucher, to determine a voucher's worth, to cash in a voucher, to modify (e.g., change sound level, configuration, font, language, etc.) electronic gaming device 2700, to select a movie or music, to select type of content to be displayed on main and/or auxiliary screen(s) of EGM, or any combination thereof.

Security Module 2750 may include security sensors, locks, interfaces, switches, etc. In at least one embodiment, may also be configured or designed to monitor and report conditions detected at each of the EGM's security sensors/switches.

Wager-Based Game Engine 2744 may be configured or designed to manage the wager-based game event portion(s) of the wager-based game.

Random Number Generator (RNG) Engine 2746 may include software and/or hardware algorithm and/or processes which are used to generate random outcomes, and may be used by the Wager-Based Game Engine to generate wager-based game event outcomes, at least a portion of which may correspond to predetermined wager-based game event outcomes (as described in greater detail below).

Display 2726 may show video streams from one or more gaming devices, gaming objects from one or more gaming devices, computer generated graphics, predetermined gaming options, and/or contingent gaming options.

Memory 2704 may include various memory modules 2740. Memory 2704 via various memory modules 2740 may include a confirmation module 2712, a validation module 2714, a voucher module 2716, a reporting module 2718, a maintenance module 2720, a player tracking preferences module 2724, and an account module 2732.

Confirmation module 2712 may utilize data received from a voucher, the transaction history of the voucher (e.g., the voucher changed hands in a secondary market), and/or the identity of the player to confirm the value of the voucher. In another example, confirmation module 2712 may utilize game event data, along with voucher data to confirm the value of the voucher.

Validation module 2714 may utilize data received from a voucher to confirm the validity of the voucher.

Voucher module 2716 may store data relating to generated vouchers, redeemed vouchers, bought vouchers, and/or sold vouchers.

Reporting module 2718 may generate reports related to a performance of electronic gaming device 2700, electronic gaming system(s), wager-based game(s), video streams, gaming objects, credit device(s), identification device(s), etc.

In one implementation, reporting module 2718 may reside on a central server and can aggregate and generate real time statistics on betting activities at one or more wager-based games at one or more participating casinos. The aggregate betting statistics may include trends (e.g., aggregate daily wager volume and wager amount by game types, by casinos, and the like), top games with the most payouts, top tables with the most payouts, top search structures used by players, most popular wager-based game(s) by wager volume, most searched for game, wager-based game(s) with least payouts, weekly trends, monthly trends, and other statistics related to game plays, wagers, people, location, and searches.

The information and statistics generated by the server-based reporting module 2718 can be displayed publicly or privately. For example, popular trending and statistical information on wager volume and wager amount for the top ten wager-based games can be publicly displayed in a casino display system so that players can study and decide what game to play, where, when, etc. Such a public display of general statistics can also be posted on the Internet, sent out as a text, an email, or multimedia message to the player's smart phones, tablets, desktop computer, etc. In another example, the trending and statistical information can also be distributed privately to privileged players such as casino club members.

Maintenance module 2720 may track any maintenance that is implemented on electronic gaming device 2700 and/or electronic gaming system 200. Maintenance module 2720 may schedule preventative maintenance and/or request a service call based on a device error.

Player tracking preferences module 2724 may compile and track data associated with a players preferences.

Account module 2732 may include data relating to an account balance, a wager limit, a number of wagers placed, credit limits, any other player information, and/or any other account information.

Data from account module 2732 may be utilized to determine whether a wager may be accepted. For example, when a search has determined a triggering event, the device and/or system may determine whether to allow this wager based on one or more of a wager amount, a number of wagers, a wager limit, an account balance, and/or any other criteria.

In at least one embodiment, at least a portion of the modules discussed in block diagram 2700 may reside locally in gaming terminal 2700. However, in at least some embodiments, the functions performed by these modules may be implemented in one or more remote servers. For instance, modules 2706-2720 and 2724 may each be on a remote server, communicating with gaming terminal 2700 via a network interface such as Ethernet in a local or a wide area network topology. In some implementations, these servers may be physical servers in a data center. In some other implementations, these servers may be virtualized. In yet some other implementations, the functions performed by these modules may be implemented as web services. For example, the predetermined game options module 2708 may be implemented in software as a web service provider. Gaming terminal 2700 would make service requests over the web for the available predetermined wager options to be displayed. Regardless of how the modules and their respective functions are implemented, the interoperability with the gaming terminal 2700 is seamless.

In one implementation, reporting module 2718 may reside on a central server and can aggregate and generate real time statistics on betting activities at one or more wager-based games at one or more participating casinos. The aggregate betting statistics may include trends (e.g., aggregate daily wager volume and wager amount by game types, by casinos, and the like), top games with the most payouts, top EGMs with the most payouts, top search structures used by players, most popular wager-based game(s) by wager volume, most searched for game(s), EGMs with least payouts, weekly trends, monthly trends, and other statistics related to game plays, wagers, people, location, and searches.

The information and statistics generated by the server-based reporting module 2718 can be displayed publicly or privately. For example, popular trending and statistical information on wager volume and wager amount for the top ten wager-based games can be publicly displayed in a casino display system so that players can study and decide what game to play, where, when, etc. Such a public display of general statistics can also be posted on the Internet, sent out as a text, an email, or multimedia message to the player's smart phones, tablets, desktop computer, etc. In another example, the trending and statistical information can also be distributed privately to privileged players such as casino club members.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

The invention claimed is:

1. A gaming machine comprising:

a cabinet including an entry that provides access to an interior of the cabinet;

a display support frame disposed at an exterior portion of the cabinet, the display support frame including a first mounting interface disposed at a first region of the display support frame and designed to enable a first display device to be mounted to the display support frame at the first region, the display support frame including a second mounting interface disposed at a second region of the display support frame and adapted to enable a second display device to be mounted to the display support frame at the second region;

an access panel assembly movably attached to the display support frame at a location between the first region and second region, the access panel assembly being movably attached to the display support frame via a first set of connectors and in a manner which enables the access panel assembly to move between a closed position and an open position;

the access panel assembly including a security plate component having a first edge disposed along a top portion of the security plate component;

the access panel assembly further including a movable safety bar component, the safety bar component being movably attached to the security plate component via a second set of connectors and in a manner which enables the safety bar component to be movable between an extended position and a retracted position;

the safety bar component including a lip portion disposed along a top edge of the safety bar component;

the access panel assembly being configured or designed such that, the lip portion of the safety bar component extends beyond the first edge of the security plate component when the safety bar component is configured in the extended position;

the access panel assembly being further configured or designed to enable the safety bar component to move in a downward direction when a downward force is exerted on the lip portion of the safety bar component; and the access panel assembly being designed to automatically move to the open position when the safety bar component is moved to the retracted position.

2. The gaming machine of claim 1:

wherein the security plate component includes a security plate body portion, the security plate body portion having a first end portion and a second end portion;

the security plate component further including a first security plate arm member connected to the first end portion, the first security plate arm member including a first connector of the second set of connectors;

the security plate component further including a second security plate arm member connected to the second end portion, the second security plate arm member including a second connector of the second set of connectors;

wherein the safety bar component includes a safety bar body portion, the safety bar body portion having a first safety bar end portion and a second safety bar end portion;

the safety bar component further including a first safety bar arm member connected to the first safety bar end portion, the first safety bar arm portion including a third connector of the second set of connectors;

the safety bar component further including a second safety bar arm member connected to the second safety bar end portion, the second safety bar arm portion including a fourth connector of the second set of connectors; and wherein the first safety bar arm member is movably attached to the first security plate arm member via engagement of the first and third connectors; and wherein the second safety bar arm member is movably attached to the second security plate arm member via engagement of the second and fourth connectors.

3. The gaming machine of claim 1:

wherein the access panel assembly is designed such that, when the access panel assembly is configured in the closed position and the safety bar component is moved into the retracted position, the access panel assembly is caused to automatically unlatch from the display support frame and caused to move to the open position.

4. The gaming machine of claim 1:

wherein the access panel assembly further includes a self-latching mechanism designed to cause the access panel assembly to automatically latch itself in the closed position to the display support frame.

5. The gaming machine of claim 1:

wherein the safety bar component is designed to operate as a self-latching mechanism to cause the access panel assembly to automatically latch itself in the closed position to the display support frame.

6. The gaming machine of claim 1:

wherein the access panel assembly includes a spring mechanism which is designed to engage with the safety bar component in a manner which causes the safety bar component to automatically move from the retracted position to the extended position.

7. The gaming machine of claim 1:

wherein the safety bar component is designed to operate as a safety mechanism for causing the access panel assembly to automatically move to the open position when the safety bar component is moved.

8. The gaming machine of claim 1:

wherein, the access panel assembly is devoid of exposed fasteners while the access panel assembly is configured in the closed position.

9. The gaming machine of claim 1:

wherein the first display device is mounted to the display support frame above the access panel assembly; and wherein the access panel assembly is designed and movably attached to the display support frame in a manner which enables the access panel assembly to be moved from the open position to the closed position while the first display device is mounted to the display support frame.

10. The gaming machine of claim 1:

wherein the first display device is mounted to the display support frame above the access panel assembly;

wherein, when the access panel assembly is moved from the open position to the closed position, the safety bar component is caused to engage with a lower edge portion of the first display device; and while the safety bar component engages with the lower edge portion of the first display device, the safety bar component is caused to move into at least a partially retracted position.

11. An access panel assembly for use in a gaming machine, the gaming machine comprising a cabinet including an entry that provides access to an interior of the cabinet, the gaming machine further including a display support frame disposed at an exterior portion of the cabinet, the display support frame including a first mounting interface disposed at a first region of the display support frame and designed to enable a first display device to be mounted to the display support frame at the first region, the display support frame including a second mounting interface disposed at a second region of the display support frame and adapted to enable a second display device to be mounted to the display support frame at the second region, the access panel assembly comprising:

a security plate component having a first edge disposed along a top portion of the security plate component, the security plate component comprising a security plate body and security plate arms attached to the security plate body, the security plate arms including a first set of connector components for movably attaching the security plate component to the display support frame in a manner which enables the access panel assembly to move between a closed position and an open position;

a movable safety bar component including a lip portion disposed along a top edge of the safety bar component, the safety bar component being movably attached to the security plate component via a second set of connector components and in a manner which enables the safety bar component to be movable between an extended position and a retracted position;

wherein the lip portion of the safety bar component extends beyond the first edge of the security plate component when the safety bar component is configured in the extended position;

the access panel assembly being configured or designed to enable the safety bar component to move in a downward direction when a downward force is exerted on the lip portion of the safety bar component;

a self-latching mechanism designed to cause the access panel assembly to latch itself in the closed position to the display support frame; and the access panel assembly being designed such that, when the access panel assembly is configured in the closed position and the safety bar component is moved into the retracted position, the access panel assembly is caused to automatically unlatch from the display support frame and caused to move to the open position.

12. The access panel assembly of claim 11:

wherein the security plate body includes a first end portion and a second end portion;

wherein a first security plate arm of the security plate arms is connected to the first end portion, the first security plate arm including a first connector of the second set of connector components;

wherein a second security plate arm of the security plate arms is connected to the second end portion, the second security plate arm including a second connector of the second set of connector components;

wherein the safety bar component includes a safety bar body portion, the safety bar body portion having a first safety bar end portion and a second safety bar end portion;

the safety bar component further including a first safety bar arm connected to the first safety bar end portion, the first safety bar arm portion including a third connector of the second set of connector components;

the safety bar component further including a second safety bar arm connected to the second safety bar end portion, the second safety bar arm portion including a fourth connector of the second set of connector components; and wherein the first safety bar arm is movably attached to the first security plate arm via engagement of the first and third connectors; and wherein the second safety bar arm is movably attached to the second security plate arm member via engagement of the second and fourth connectors.

13. The access panel assembly of claim 11:

wherein the safety bar component is designed to operate as a component of the self-latching mechanism, and wherein, when the access panel assembly is moved to the closed position, the safety bar component is caused to automatically engage with and latch to the display support frame.

14. The access panel assembly of claim 11 further comprising:

a spring component which is designed to engage with the safety bar component in a manner which causes the safety bar component to automatically move from the retracted position to the extended position.

15. The access panel assembly of claim 11:

wherein the safety bar component is designed to operate as a safety mechanism for causing the access panel assembly to automatically move to the open position when the safety bar component is moved by moving the safety bar component to the retracted position.

16. The access panel assembly of claim 11:

wherein, the access panel assembly is devoid of exposed fasteners while the access panel assembly is mounted to the display support frame and configured in the closed position.

17. The access panel assembly of claim 11:

wherein the access panel assembly is movably attachable to the display support frame in a manner which enables the access panel assembly to be moved from the open position to the closed position while the first display device is mounted to the display support frame.

18. The access panel assembly of claim 11:

the access panel assembly being designed such that, when the access panel assembly is movably attached to the display support frame and the access panel assembly is moved from the open position to the closed position, the safety bar component is caused to engage with a lower edge portion of the first display device; and while the safety bar component engages with the lower edge portion of the first display device, the safety bar component is caused to move into at least a partially retracted position.

* * * * *